United States Patent [19]

Hanada et al.

[11] Patent Number: 4,745,439

[45] Date of Patent: May 17, 1988

[54] COPYING APPARATUS

[75] Inventors: Yoshihiro Hanada; Yasuo Nakamura, both of Toyokawa; Kazuyuki Fukui, Toyohashi, all of Japan

[73] Assignee: Minolta Camera Kabushiki Kaisha, Osaka, Japan

[21] Appl. No.: 875,612

[22] Filed: Jun. 18, 1986

[30] Foreign Application Priority Data

| | | | |
|---|---|---|---|
| Jul. 2, 1985 | [JP] | Japan | 60-146150 |
| Jul. 5, 1985 | [JP] | Japan | 60-148918 |
| Jul. 5, 1985 | [JP] | Japan | 60-148919 |
| Jul. 8, 1985 | [JP] | Japan | 60-151057 |

[51] Int. Cl.[4] ..... G03G 21/00; B65H 5/22

[52] U.S. Cl. ..... 355/14 SH; 271/3.1

[58] Field of Search ..... 355/3 R, 3 SH, 14 SH, 355/24, 25, 26; 271/3.1

[56] References Cited

U.S. PATENT DOCUMENTS

| | | | |
|---|---|---|---|
| 3,645,615 | 2/1972 | Spear, Jr. | 355/3 |
| 3,743,406 | 7/1973 | Komori et al. | 355/14 SH X |
| 4,162,844 | 7/1979 | Traister et al. | 355/14 |
| 4,253,759 | 3/1981 | Rattin | 355/14 SH |
| 4,272,180 | 6/1981 | Satomi et al. | 355/14 SH X |
| 4,365,886 | 12/1982 | Murakami | 355/3 |
| 4,537,497 | 8/1985 | Masuda | 355/14 |
| 4,568,169 | 2/1986 | Wado et al. | 355/3 SH |
| 4,585,336 | 4/1986 | Tanaka | 355/3 SH |

FOREIGN PATENT DOCUMENTS

| | | | |
|---|---|---|---|
| 54-109445 | 8/1979 | Japan | 355/3 SH |
| 59-211059 | 11/1984 | Japan | 355/3 SH |

*Primary Examiner*—Fred L. Braun

*Attorney, Agent, or Firm*—Burns, Doane, Swecker & Mathis

[57] ABSTRACT

A copying apparatus capable of effecting duplex copying and composite copying and including an intermediate tray member for storing a plurality of copy paper sheets each having one copied face and refeeding the stored copy paper sheets one sheet by one sheet and a mounting member for detachably mounting the intermediate tray member on an apparatus housing of the copying apparatus in a direction perpendicular to a transport direction of the copy paper sheets. The intermediate tray member includes a storage portion for storing the copy paper sheets, first and second transport portions for transporting the copy paper sheets to the storage portion at the time of duplex copying and composite copying, respectively and a paper feeding device for feeding the copy paper sheets stored in the storage portion.

8 Claims, 18 Drawing Sheets

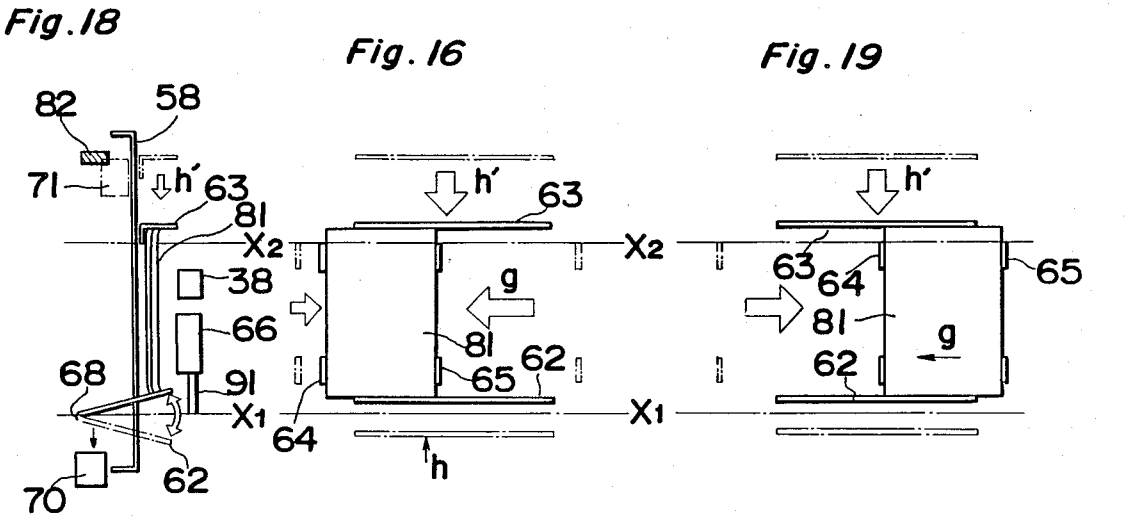
Fig. 18
Fig. 16
Fig. 19
58
82
71
h'
63
81
X2
38
66
91
X1
62
68
70
h
64
g
65
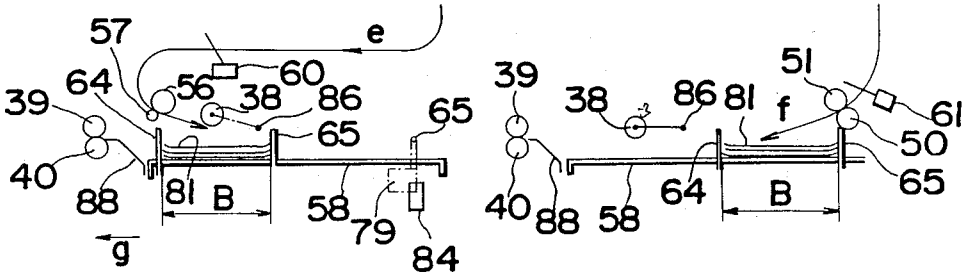
Fig. 17
Fig. 20
e
60
56
57
64
39
40
38
86
65
58
79
84
88
81
B
g
61
50
51
f

COPYING APPARATUS

BACKGROUND OF THE INVENTION

The present invention generally relates to copying apparatuses and more particularly, to an electrophotographic copying apparatus enabling duplex copying and composite copying.

Recently, copying apparatuses having various functions have been developed. Such functions include duplex copying in which copying is performed on opposite faces of each copy paper sheet and composite copying in which different images, for example a frame and characters in the frame are copied onto one face of each copy paper sheet by using different colors. In order to perform the functions of this kind, it is necessary to temporarily transport onto an intermediate tray the copy paper sheet having subjected to initial copying and then, refeed the copy paper sheet. In the case of duplex copying, the copy paper sheet is required to be turned over.

Thus, firstly, an arrangement was proposed in, for example U.S. Pat. No. 4,162,844 in which a feed passage changeover device is provided at an outlet of a fixing device and, at the time of duplex copying, the copying paper sheet discharged from the fixing device is temporarily transported into an upper turnover feed passage so as to be conveyed, through so-called switchback thereof, onto the intermediate tray in a turnover state.

However, in the known switchback method referred to above, since the turnover feed passage of the copy paper sheet is required to be provided at right angles to a transport passage of the copy paper sheet, such problems arise that space efficiency in the copying apparatus becomes deteriorated and copying speed drops due to loss in time for transporting the copy paper sheet. Furthermore, the known arrangement is disadvantageous in that since the turnover feed passage is incorporated in the copying apparatus, it is quite troublesome to remove a jammed copy paper sheet if jamming of the copy paper sheet takes place at the turnover feed passage.

Secondly, in the prior art copying apparatuses, the copy paper sheet may be readily curled due to heat of fixing of a toner image on the copy paper sheet, which fixing is performed by the fixing device before the copy paper sheet is transported onto the intermediate tray. Especially, when a number of the upwardly curled copy paper sheets are stacked on the intermediate tray, height of the copy paper sheets on the intermediate tray becomes large. If the copy paper sheets are aligned with each other on the intermediate tray in this state, regulating plates for regulating leading and trailing edges of each copy paper sheet are required to be made large in height, so that space for the intermediate tray increases, thereby making the copying apparatus itself large in size.

Thirdly, in the known copying apparatuses, in the case an arrangement is employed in which the copy paper sheet is turned over immediately before being transported onto the intermediate tray, diameters of turnover transport rollers for turning over the copy paper sheet should be taken into consideration in connection with space of the arrangement. Furthermore, in the arrangement, it is necessary to positively turn over a hard copy paper sheet like a board, a soft copy paper sheet like a thin paper and a curled copy paper sheet. On the other hand, it is preferable that the copy paper sheet is turned over at as large a radius as possible such that improper turnover of the copy paper sheet is minimized. However, if the turnover radius is made excessively large, the copying apparatus becomes large in size undesirably.

Fourthly, in the known copying apparatuses, a refeeding means is required to be retracted upwardly when the copy paper sheet is transported onto the intermediate tray. Furthermore, the copy paper sheet may be readily curled due to heat of fixing the toner image on the copy paper sheet, which fixing is performed by the fixing device before the copy paper sheet is transported onto the intermediate tray. Especially, in the case where the opposite lengthwise sides of the copy paper sheet are curled upwardly in a widthwise direction of the copy paper sheet, such a problem is incurred unless the copy paper sheet is depressed from above by any guide means that opposite lengthwise side portions of the copy paper sheet are not guided by side regulating plates, thereby resulting in improper refeeding of the copy paper sheet, e.g. oblique refeeding of the copy paper sheet.

SUMMARY OF THE INVENTION

Accordingly, an essential object of the present invention is to provide a copying apparatus which is free of these drawbacks and capable of reversing a copy paper sheet with compact and simple construction.

Another object of the present invention is to provide a copying apparatus of the above described type in which transport speed of a copy paper sheet is increased through efficient utilization of space in the copying apparatus and jamming of the copy paper sheet can be dealt with easily by drawing a unit out of the copying apparatus even if jamming of the copy paper sheet takes place at a turnover portion, etc., with substantial elimination of the disadvantages inherent in conventional copying apparatuses of this kind.

Still another object of the present invention is to provide a copying apparatus of the above described type in which the copy paper sheet can be turned over positively regardless of thickness of the copy paper sheet.

Still another object of the present invention is to provide a copying apparatus of the above described type in which even if the opposite lengthwise side portions of the copy paper sheet are curled upwardly in its widthwise direction, the copy paper sheet can be guided positively on an intermediate tray, thereby obviating improper refeeding of the copy paper sheet such as oblique transport of the copy paper sheet.

In order to accomplish these objects of the present invention, a copying apparatus embodying the present invention is capable of effecting duplex copying and composite copying and comprises: an intermediate tray means for storing a plurality of copy paper sheets transported thereto and refeeding the stored copy paper sheets therefrom one sheet by one sheet, with the copy paper sheets each having one copied face; said intermediate tray means comprising a storage portion for storing and stacking thereon the copy paper sheets transported sequentially thereto, a first transport portion, a second transport portion and a paper feeding means for feeding one sheet by one sheet the copy paper sheets stored in said storage portion; said first transport portion being pivotally provided at least partially so as to be pivoted relative to said storage portion and transporting the copy paper sheets to said storage portion through turnover of the copy paper sheets at the time of duplex copying such that each of the copy paper sheets on said storage portion has the one copied face directed upwardly; said second transport portion transporting the copy paper sheets to said storage portion at the time of composite copying such that each of the copy paper sheets on said storage portion has the one copied face directed downwardly; and a mounting means for detachably mounting said intermediate tray means on an apparatus housing of said copying apparatus in a direction perpendicular to a transport direction of the copy paper sheets.

BRIEF DESCRIPTION OF THE DRAWINGS

These objects and features of the present invention will become apparent from the following description taken in conjunction with the preferred embodiment thereof with reference to the accompanying drawings, in which:

FIG. 16 is a top plan view of the alignment mechanism of FIG. 5 at the time of turnover copying;

FIG. 17 is a front elevational view of FIG. 16;

FIG. 18 is a side elevational view of FIG. 16;

FIG. 19 is a top plan view of the alignment mechanism at the time of composite copying;

FIG. 20 is a front elevational view of FIG. 19;

Before the description of the present invention proceeds, it is to be noted that like parts are designated by like reference numerals throughout several views of the accompanying drawings.

DETAILED DESCRIPTION OF THE INVENTION

Figure 1:
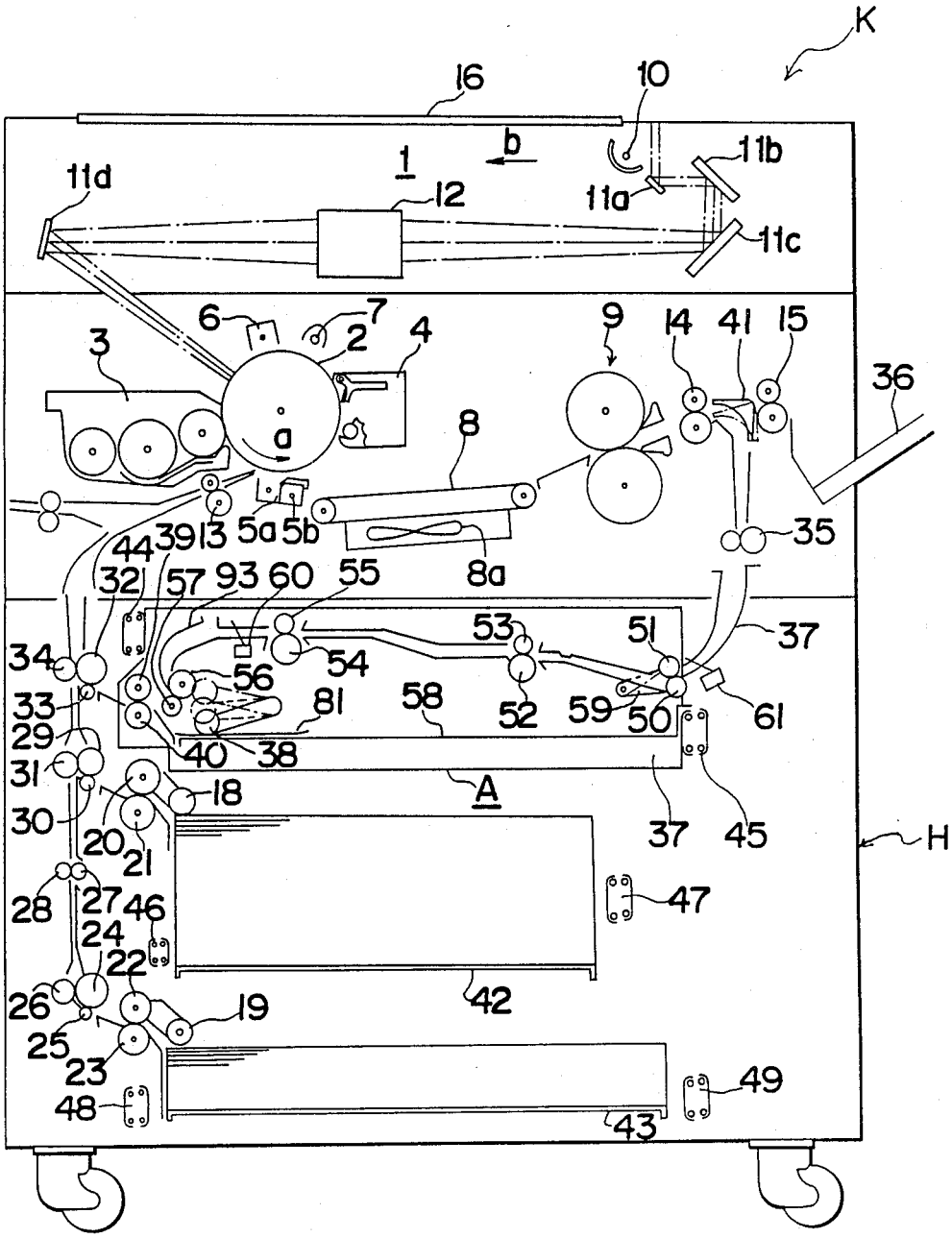
FIG. 1 is a view showing a whole construction of a copying apparatus according to one embodiment of the present invention.

Hereinbelow, a copying apparatus K according to one preferred embodiment of the present invention will be described with reference to the accompanying drawings.

Initially, a whole construction and operations of the copying apparatus K is described with reference to FIG. 1. The copying apparatus K includes a photosensitive drum 2 provided at a central portion of an apparatus hosing H of the copying apparatus K and rotatable in the direction of the arrow a. Around the photosensitive drum 2, a corona charger 6, a magnetic brush type developing device 3, a transfer charger 5*a*, a charge eraser 5*b*, a blade type cleaning device 4 and an eraser lamp 7 are sequentially disposed in this order. Upon rotation of the photosensitive drum 2 in the direction of the arrow a, the photosensitive drum 2 is subjected to uniform corona charging by the corona charger 6 and then, is subjected to exposure by an optical system 1 such that an electrostatic latent image is formed on the photosensitive drum 2. The electrostatic latent image is developed into a visible toner image by the developing device 3.

The optical system is movably provided below an original platform 16 made of glass so as to scan an original document on the original platform in the direction of the arrow b and is constituted by a light source 10, movable mirrors 11*a*, 11*b* and 11*c*, an imaging lens 12 and a fixed mirror 11*d*. When the drum 2 rotates at a peripheral velocity V (which is constant irrespective of magnification), the light source 10 and the movable mirror 11a travel unitedly leftward at a velocity of V/m (where m is a magnification), while the movable mirrors 11*b* and 11*c* travel unitedly leftward at a velocity of V/2 m.

On the other hand, a copy paper storage portion is constituted by an upper storage portion 42 of elevator type and a lower storage portion 43 of cassette type, which are drawably provided so as to be drawn out of the apparatus housing H forwardly by using rails 46 and 47 and rails 48 and 49, respectively. Copy paper sheets stacked in the upper storage portion 42 and the lower storage portion 43 are selectively fed, through their separation into a single copy paper sheet effected by a pair of separating rollers 20 and 21 and a pair of separating rollers 22 and 23, one sheet by one sheet upon rotation of paper feeding rollers 18 and 19, respectively and then, are conveyed to timing rollers 13 via a group of transport rollers 29, 30, 31, 32, 33 and 34 and a group of transport rollers 24, 25, 26, 27 and 28, respectively. After the copy paper sheets have been temporarily stopped at the timing rollers 13, the copy paper sheets are transported to a transfer portion synchronously with the above described toner image formed on the photosensitive drum 2 such that the toner image is transferred onto the copy paper sheets through electric discharge of the transfer charter 5*a*. In addition, the copy paper sheets are separated from the surface of the photosensitive drum 2 through electric discharge of the charge eraser 5*b* and then, are conveyed to a fixing device 9 by a transport belt 8 including an air suction means 8*a* such that the toner image on the copy paper sheets is subjected to fusion fixing by the fixing device 9.

A lever 41 for effecting changeover of a feed passage of the copy paper sheets is provided between transport rollers 14 and discharge rollers 15, with the transport rollers 14 being disposed in the close vicinity of the outlet of the fixing device 9. In the case where the copy paper sheets are discharged directly to a tray 36, the lever 41 is set at the position shown by the one-dot chain lines of FIG. 1 and thus, the copy paper sheets transported from the fixing device 9 are discharged from the discharge rollers 16 onto the tray 36. Meanwhile, in the case where duplex copying or composite copying to be described later in detail is performed, the lever 41 is set at the position shown by the solid lines of FIG. 1 and thus, the copy paper sheets are conveyed from transport rollers 35, through a guide plate 37, to an intermediate tray unit A to be described later.

On the other hand, after the toner image on the photosensitive drum 2 has been transferred onto the copy paper sheets, residual toner is removed from the photosensitive drum 2 by the cleaning device 4 and residual electric charge is removed from the photosensitive drum 2 by light irradiated by the eraser lamp 7 such that the photosensitive drum 2 is ready for the next copying operation.

Hereinbelow, constructions of the intermediate tray unit A will be described briefly with reference to FIGS. 1 to 3. The intermediate tray unit A is designed to store the copy paper sheets each having one copied face so as to align the copy paper sheets with each other and refeed the aligned copy paper sheets. The intermediate tray unit A is constituted by a changeover block I, a transfer block Ii, a turnover block III, an intermediate alignment block IV and a refeeding block V which are integrally assembled with each other as one unit. The intermediate tray unit A is drawably supported, at its opposite sides, by rails 44 and 45 so as to be drawn out of the apparatus housing H forwardly, i.e. in the direction perpendicular to the feed passage of the copy paper sheets as shown in FIG. 2. The intermediate tray unit A is arranged to be drawn out of the apparatus housing H such that maintenance of the copying apparatus K and disposal of jamming of the copy paper sheets are facilitated.

The inner construction of the intermediate tray unit A will be explained in detail hereinbelow with reference to FIG. 3.

The changeover block I is arranged to direct the copied face of the copy paper sheets upwardly and downwardly when the copy paper sheets are transported into the intermediate tray unit A for duplex copying and composite copying, respectively. The changeover block I is constituted by transport rollers 50 and 51 and a changeover lever 59. Meanwhile, it can also be so arranged that the changeover block I is provided on the apparatus housing H without being provided in the intermediate tray unit A.

The transport block II is arranged to transport to the turnover block III (described later) the copy paper sheets to be subjected to duplex copying and is constituted by transport rollers 52, 53, 54 and 55 and guide plates 201, 202, 203 and 204. When the intermediate tray unit A has been drawn out of the apparatus housing H forwardly, the transport block II can be pivoted upwardly about a support shaft 95 as shown by the one-dot chain lines of FIG. 3 such that disposal of jamming of the copy paper sheets in the intermediate tray unit A is facilitated.

The turnover block III is constituted by turnover transport rollers 56 and 57 and a turnover guide plate 93 so as to turn over and convey into an intermediate tray 58 the copy paper sheets transported through the transport block II.

Figure 5:
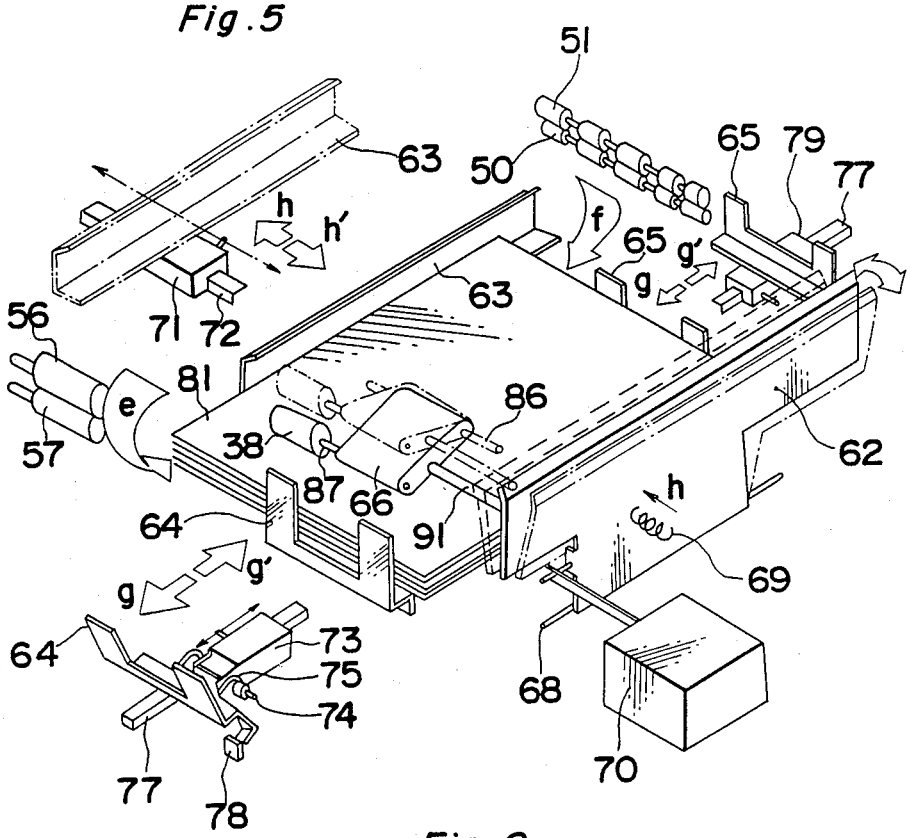
FIG. 5 is an exploded perspective view of an alignment mechanism and a refeeding mechanism employed in the copying apparatus of FIG. 1.

The intermediate alignment block IV is constituted by the intermediate tray 58, a slide rail 77, slide members 73 and 79 and regulating plates 62, 63, 64 and 65 (the regulating plates 62, 63, 64 and 65 are shown in FIG. 5) so as to align with each other the copy paper sheets transported onto the intermediate tray 58.

Meanwhile, the refeeding block V is constituted by a holder 66, a refeeding roller 38, separating rollers 39 and 40 and a guide plate 88 so as to refeed one sheet by one sheet the copy paper sheets aligned on the intermediate tray 58.

Figure 2:
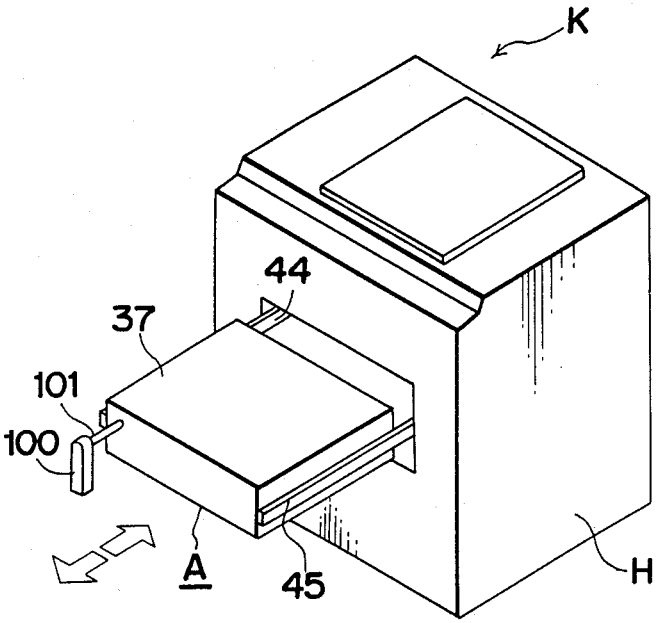
FIG. 2 is a perspective view of the copying apparatus of FIG. 1.

When either one of a duplex copying mode and a composite copying mode has been selected by depressing a selective key on an operating panel (not shown), the change-over lever 41 referred to earlier is changed over to the position shown by the solid lines of FIG. 1 and thus, the copy paper sheets each having one copied face are guided from the transport rollers 35 to the transport rollers 50 and 51 by the guide plate 37.

Figure 3:
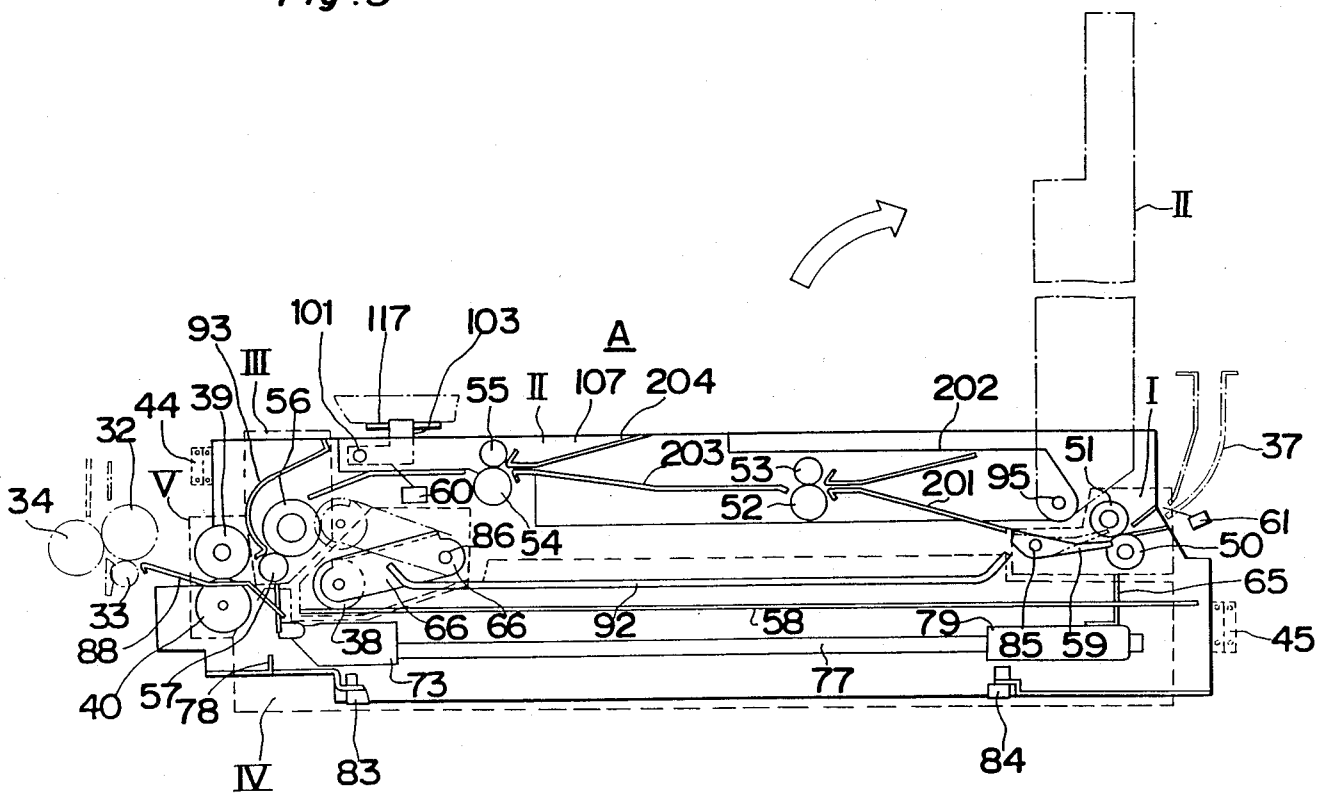
FIG. 3 is a view showing an inner construction of a unit employed in the copying apparatus of FIG. 1.

Another changeover lever 59 is pivotally provided so as to be pivoted about a shaft 85 and is set at the position shown by the solid lines of FIG. 3 at the time of duplex copying. At this time, the copy paper sheets fed into the intermediate tray unit A are guided to the transport block II by an upper face of the changeover lever 59 and then, are conveyed in the leftward direction in FIG. 3 by the transport rollers 52, 53, 54 and 55 through guide of the guide plates 201, 202, 203 and 204. Subsequently, the copy paper sheets are turned over by the turnover transport rollers 56 and 57 and the turnover guide plate 93 such that the copy paper sheets each having one copied face directed upwardly are transported onto the intermediate tray 58. Thereafter, the copy paper sheets are aligned with each other on the intermediate tray 58 by the intermediate alignment tray block IV so as to be refed one sheet by one sheet upon clockwise rotation of the refeeding roller 38.

On the other hand, at the time of composite copying, the changeover lever 59 is set at the position shown by the one-dot chain lines of FIG. 3. At this time, the copy paper sheets are guided by a lower face of the changeover lever 59 immediately after having passed through the transport rollers 50 and 51 such that the copy paper sheets each having one copied face directed downwardly are directly conveyed onto the intermediate tray 58. Subsequently, the copy paper sheets are refed one sheet by one sheet upon clockwise rotation of the refeeding roller 38 in the same manner as duplex copying.

The refed copy paper sheets are transported, through their separation into a single copy paper sheet effected by the separating rollers 39 and 40, to the timing rollers 13 via the transport rollers 32, 33 and 34. Thereafter, duplex copying or composite copying is performed in the same manner as an ordinary copying operation. Meanwhile, the refeeding roller 38 is pivotally provided so as to be pivoted about a support shaft 86 of the holder 66 (see FIG. 3) such that the refeeding roller 38 is positioned at three stages shown by the one-dot chain lines, the dotted lines and the solid lines in FIG. 1, respectively. when the copy paper sheets are transported to the intermediate tray 58, the refeeding roller 38 is positioned at the upper stage or the intermediate stage as will be described in detail later. At the time of refeeding of the copy paper sheets, the refeeding roller 38 is brought into pressing contact, at a proper pressure, with the copy paper sheets aligned on the intermediate tray 58.

Figure 4:
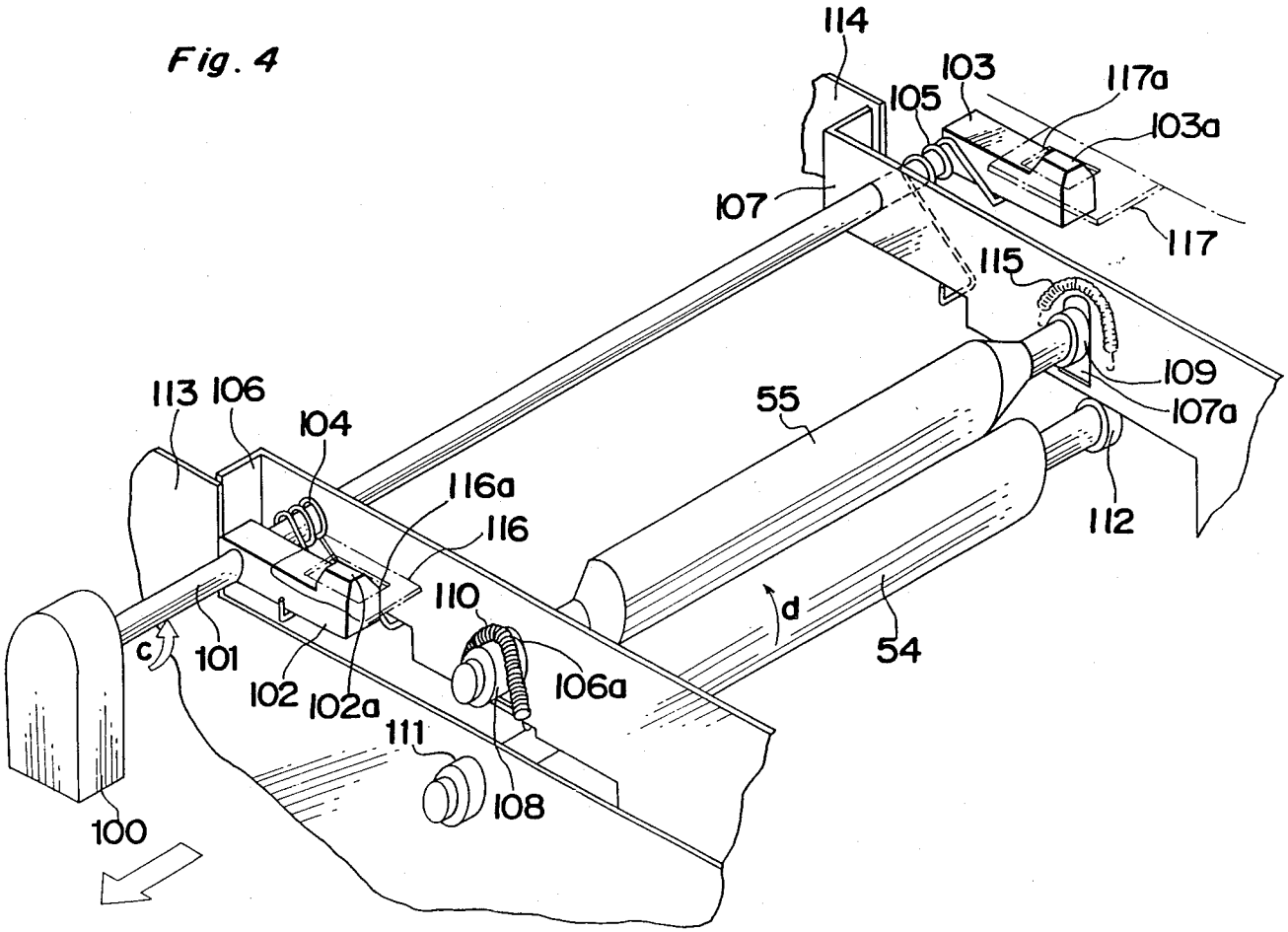
FIG. 4 is an perspective view of a lock mechanism employed in the copying apparatus of FIG. 1.

Hereinbelow, a unit lock mechanism will be described with reference to FIG. 4. The unit lock mechanism not only locks the intermediate tray unit A in the apparatus housing H but also locks the transport block II to the intermediate tray unit A so as to hold the upper transport roller 55 and the lower transport roller 54 in pressing contact with each other. In the unit lock mechanism, a shaft 101 is rotatably fitted through frames 106 and 107 of the transport block II. An operating lever 100 is mounted on one end portion of the shaft 101 adjacent to the frame 106. Furthermore, lock levers 102 and 103 are mounted on the shaft 101 so as to be disposed axially outwardly of the frames 106 and 107, respectively. A torsion spring 104 wound, between the frame 106 and the lock lever 102, around the shaft 101 is engaged, at opposite ends thereof, with the lock lever 102 and the frame 106, respectively. Likewise, a torsion spring 105 wound, between the frame 107 and the lock lever 103, around the shaft 101 is engaged, at opposite ends thereof, with the lock lever 103 and the frame 107, respectively. Accordingly, the shaft 101 is urged together with the operating lever 100 and the lock levers 102 and 103 in the direction of the arrow c by the torsion springs 104 and 105. At this time, protrusions 102*a* and 103*a* of the lock levers 102 and 103 are, respectively, inserted from below into openings 116*a* and 117*a* formed on projecting pieces 116 and 117 of a frame of the apparatus housing H, respectively, where by the intermediate tray unit A is locked relative to the apparatus housing H and the transport block II is prevented from being pivoted upwardly. As shown in FIG. 4, bent end portions of the frames 106 and 107 are inwardly brought into contact with frames 113 and 114 of the intermediate tray unit a so as to be engaged with the intermediate tray unit A. Meanwhile, as shown in FIG. 3, since the support shaft 95 is coupled with the frames 113 and 114 of the intermediate tray unit A and the frames 106 and 107 of the transport block II, the transport block II can be pivoted upwardly about the support shaft 95.

In order to release locking of the intermediate tray unit A to the apparatus housing H, the operating lever 100 is rotated in the direction opposite to the direction of the arrow c from the state shown in FIG. 4 against an urging force of the torsion springs 104 and 105, so that the lock levers 102 and 103 are disengaged from the openings 116*a* and 117*a* of the projecting pieces 116 and 117, respectively and thus, it becomes possible to draw the intermediate tray unit A out of the apparatus housing H forwardly. At the same time, locking of the transport block II to the intermediate tray unit A is released and therefore, can be pivoted upwardly about the support shaft 95. Meanwhile, it is so arranged that when the transport block II has been pivoted upwardly about the support shaft 95, the transport block II is prevented by a stopper member (not shown) provided on the intermediate tray unit A from being pivoted further from the position shown in the one-dot chain lines of FIG. 3. Namely, the transport block II can be locked to the intermediate tray unit A by the single unit lock mechanism.

Meanwhile, as shown in FIG. 4, the lower transport roller 54 is mounted on the frames 113 and 114 of the intermediate tray unit A through bearings 111 and 112, respectively and is arranged to be driven in the direction of the arrow d by a driving means (not shown). The upper transport roller 55 is provided, at opposite ends thereof, with bearings 108 and 109. Since the bearings 108 and 109 are loosely inserted into guide slots 106*a* and 107*a* formed on the frames 106 and 107 in the vertical direction, the transport roller 55 is vertically movable and rotatable. Coiled springs 110 and 115 are attached to outer faces of the frames 106 and 107, respectively and are engaged with the bearings 108 and 109 from above, respectively so as to urge the transport roller 55 downwardly. Accordingly, when the transport block II is locked to the intermediate tray unit A, the transport roller 55 is brought into pressing contact with the transport roller 54 at a proper predetermined pressure by an urging force of the coiled springs 110 and 115 so as to be driven for rotation thereof upon rotation of the transport roller 54. when the transport block II has been pivoted upwardly after release of locking of the transport block II to the intermediate tray unit A, the bearings 108 and 109 are, respectively, brought into contact with lower edgse of the guide slots 106*a* and 107*a* by the urging force of the coiled springs 110 and 115 and thus, the transport roller 55 is brought out of pressing contact with the transport roller 54.

Thus, the lower transport roller 54 is mounted on the frames 113 and 114 of the intermediate tray unit A. This is aimed at driving a driving force transmission mechanism (not shown) for the transport roller 54 by the use of a mechanism in common with other driving members of the intermediate tray unit A. Hence, it becomes necessary to provide a means for bringing the transport roller 55 into pressing contact with the transport roller 54 at a proper pressure. To this end, the coiled springs 110 and 115 are employed as an elastic urging means and the lock mechanism for securing the transport block II at the predetermined position is provided.

Then, an alignment mechanism for aligning the copy paper sheets 81 transported onto the intermediate tray 58 is described with reference to FIGS. 5 to 8. In FIG. 5, the arrow e indicates a direction of feed of the copy paper sheets 81 onto the intermediate tray 58 at the time of duplex copying. Similarly, the arrow f indicates a direction of feed of the copy paper sheets 81 onto the intermediate tray 58 at the time of composite copying, while the arrow g indicates a refeeding direction of the copy paper sheets 81.

The copy paper sheets 81 are aligned with each other by the four regulating plates 62, 63, 64 and 65. The side regulating plate 62 is pivotally provided so as to be pivoted about a support shaft 68, while another side regulating plate 63 is movably mounted on a slide rail 72 through a slide member 71. The front regulating plate 64 and the rear regulating plate 65 are movably mounted on the slide rail 77 through the slide members 73 and 79, respectively. When the slide member 71 is driven by a stepping motor (not shown), the side regulating plate 63 is displaced in the directions of the arrows h and h'. Likewise, when the slide members 73 and 79 are driven by stepping motors (not shown), the front and rear regulating plates 64 and 65 are displaced in the directions of the arrows g and g'. Amounts of displacement of the regulating plates 63, 64 and 65 are set to predetermined values by controlling rotational angles of the stepping motors, respectively.

Figure 6:
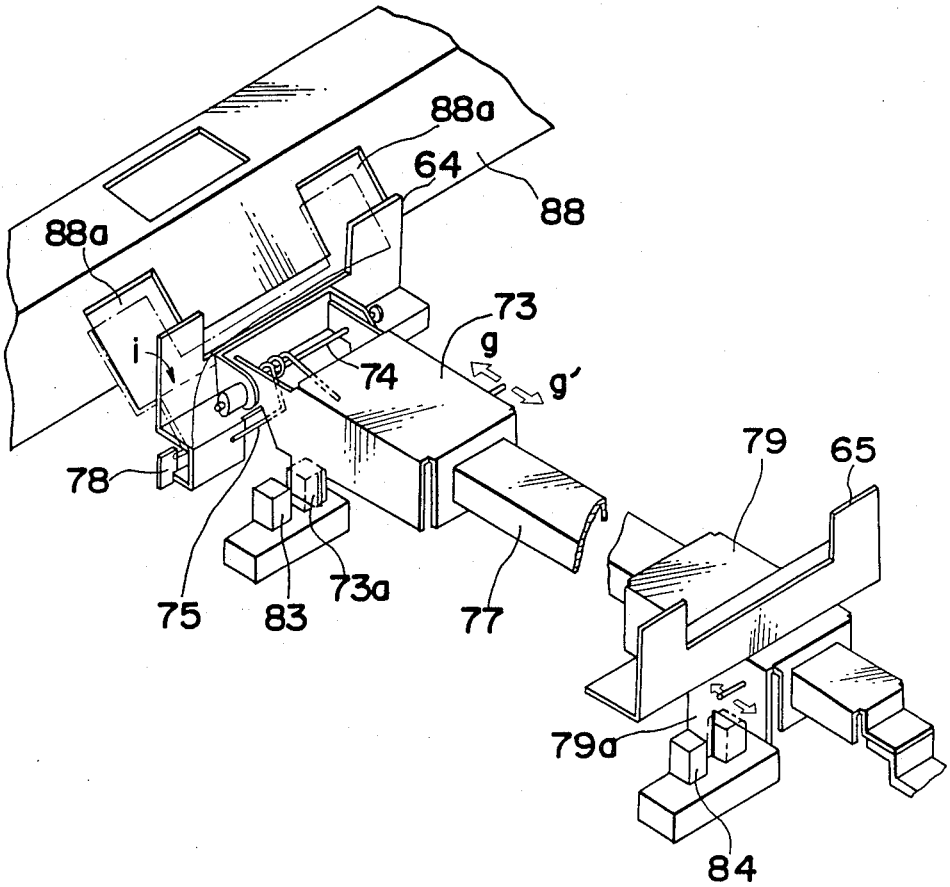
FIG. 6 is a perspective view of a mounting portion for regulating plates employed in the copying apparatus of FIG. 1.
Figure 7:
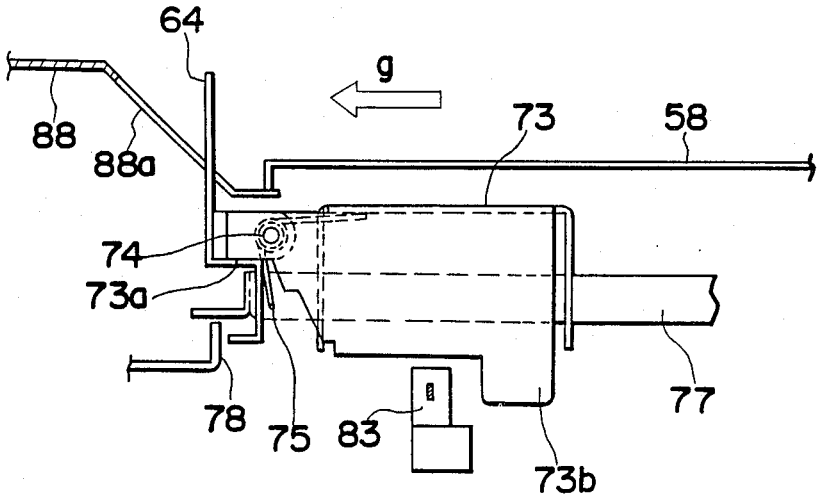
FIGS. 7 and 8 are views explanatory of operations of a front regulating plate employed in the copying apparatus of FIG. 1.

As shown in FIG. 6, the front regulating plate 63 is pivotally mounted on the slide member 73 so as to be pivoted about a support shaft 74 and is urged in the direction of the arrow i by a torsion spring 75 wound around the support shaft 74. The regulating plate 64 is usually so regulated by a lower edge 73*a* of a projection of the slide member 73 as to extend at right angles to the intermediate tray 58 as shown in FIG. 7. This front regulating plate 64 disposed at the position of FIG. 7 aligns leading edges of the copy paper sheets 81 transported onto the intermediate tray 58. At the time of refeeding of the copy paper sheets 81, the slide member 73 is displaced in the direction of the arrow g, so that the front regulating plate 64 is pivoted, through contact of its lower end with a stopper 78, about the support shaft 74 in the direction of the arrow i' against an urging force of the torsion spring 75 as shown in FIG. 8 so as to be retracted into a pair of recesses 88*a* formed on the guide plate 88 such that refeeding of the copy paper sheets 81 can be performed.

Figure 8:
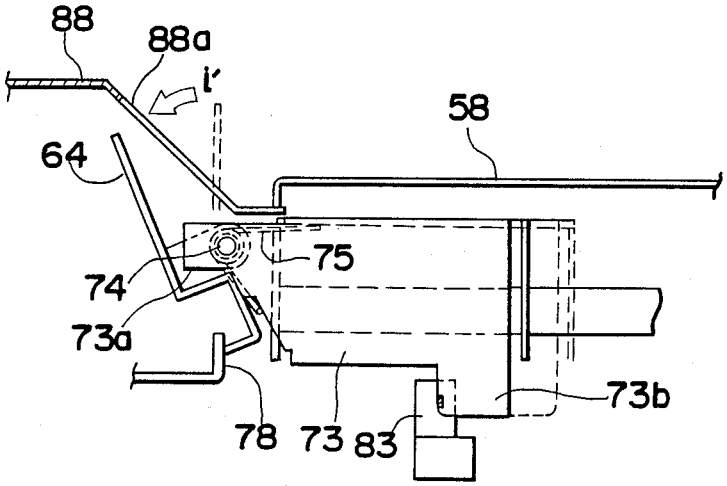

The front regulating plate 64 can be displaced to a refeeding position shown by the solid lines of FIG. 8, an alignment position (FIG. 7) for aligning the leading edges of the copy paper sheets 81 and a temporary alignment position for composite copying. The temporary alignment position of the front regulating plate 64, which will be explained later, varies according to size of the copy paper sheets 81. Positional control of the front regulating plate 64 is based on detection of a protrusion 73*b* of the slide member 73 by a transmission type photosensor 83 as shown in FIG. 8. Similarly, as shown in FIG. 6, positional control of the rear regulating plate 65 is based on detection of a protrusion 79*a* of the slide member 79 by a transmission type photosensor 84. Positional control of the side regulating plate 63 is likewise based on detection of a fixed position of the slide member 71 by a transmission type photosensor 82 as shown in FIG. 18.

Meanwhile, as shown in FIG. 5, the side regulating plate 62 is coupled with a solenoid 70 and is urged in the direction of the arrow h by a coiled spring 69. Since the solenoid 70 is usually de-energized, the side regulating plate 62 is disposed at the position shown by the dotted lines of FIG. 5 through its contact with a stopper (not shown). At the time of refeeding of the copy paper sheets, the side regulating plate 62 is brought into contact with a stopper 91 formed on the holder 66 of the refeeding roller 38 so as to be set at the position shown by the solid lines of FIG. 5. When the solenoid 70 has been energized, the side regulating plate 62 is pivoted about the supported shaft 68 to the position shown by the one-dot chain lines of FIG. 5 against an urging force of the coiled spring 69.

Figure 10:
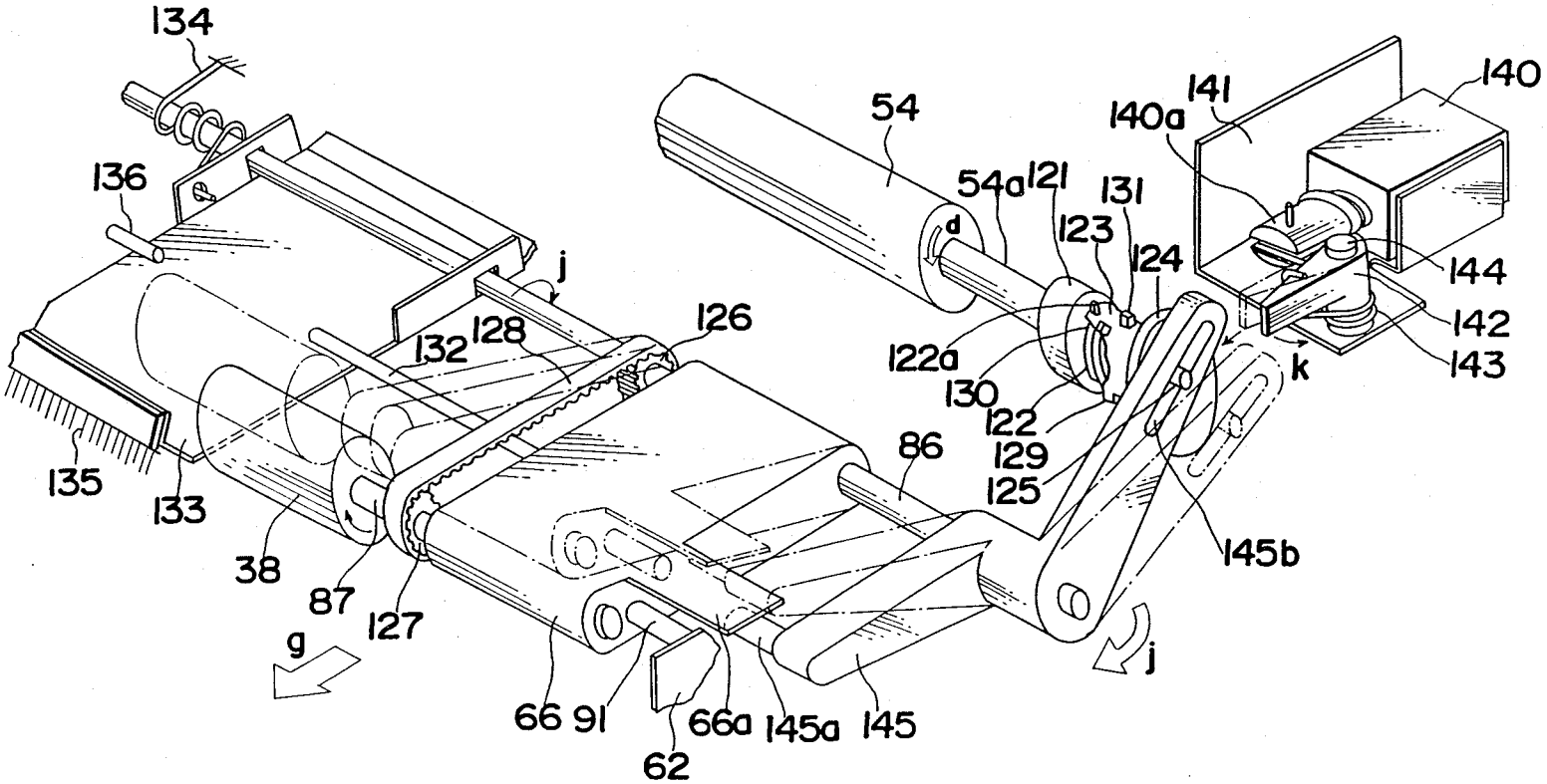
FIG. 10 is a perspective view of a pivotal mechanism for a refeeding roller of the copying apparatus of FIG. 1.

Then, constructions and operations of a pivotal mechanism for pivoting the refeeding roller 38 are described with reference to FIGS. 10 to 15. As shown in FIG. 10, the refeeding roller 38 is supported, at its one end, by a support shaft 87 which is rotatably fitted into the holder 66. The holder 66 is secured, at its rear end, to the support shaft 66 which is rotatably supported by the frames 113 and 114 (FIG. 4) of the intermediate tray unit A. The support shaft 86 is driven for rotation thereof by a driving means (not shown) in the direction of the arrow j. This rotation of the support shaft 86 is transmitted to the refeeding roller 38 through a timing belt 128 trained over pulleys 126 and 127 which are mounted on the support shafts 86 and 87, respectively. Namely, the support shaft 86 is coupled with a driving means of each transport roller of the intermediate tray unit A by a clutch (not shown). This clutch is actuated only at the time of refeeding of the copy paper sheets such that the refeeding roller 38 is driven for rotation thereof in the direction of the arrow j.

Figure 12:
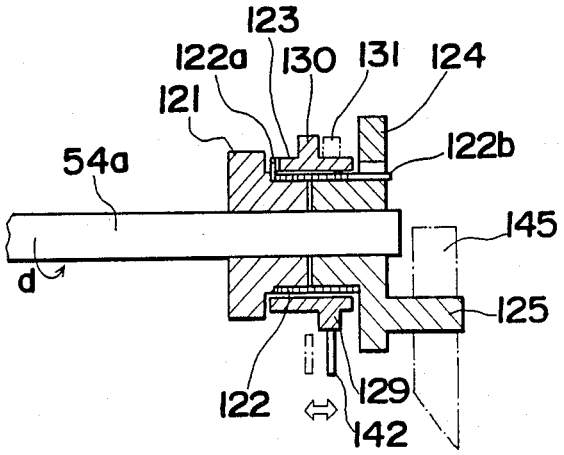
FIG. 12 is a sectional view of a clutch means of the copying apparatus of FIG. 1.

A pivotal lever 145 is pivotally mounted on one end of the support shaft 86. A shaft 145*a* mounted on one end of the pivotal lever 145 confronts a projecting piece 66*a* of the holder 66 from below. Meanwhile, a pin 125 driven into a clutch plate 124 which is rotatably mounted on a support shaft 54*a* of the transport roller 54 is loosely inserted into an elongated opening 145*b* formed on the other end of the pivotal lever 145. As shown in FIG. 12, another clutch plate 121 is secured to one end of the support shaft 54*a*. A kick spring 122 is wound around boss portions of the clutch plates 121 and 124. Furthermore, a collar 123 provided, at its outer periphery, with claw portions 129, 130 and 131 is fitted around the kick spring 122. One end 122*a* and the other end 122*b* of the kick spring 122 are, respectively, engaged with the collar 123 and the clutch plate 124. Namely, the kick spring 122 in its free state clamps the boss portions of the clutch plates 121 and 124 such that rotation of the support shaft 54*a* in the direction of the arrow d is transmitted from the clutch plate 121 to the clutch plate 124 and the collar 123 by the kick spring 122. On the other hand, when rotation of the collar 123 is prevented by a lever 142 described below, rotation in the direction of the arrow d, which is transmitted from the support shaft 54*a* to the clutch plate 121, is so exerted as to rewind the kick spring 122, so that the clutch plate 121 is rotated through slip between the clutch plate 121 and the kick spring 122 and thus, the rotation in the direction of the arrow d is not transmitted to the clutch plate 124.

A means for actuating the above described clutch means is, as shown in FIG. 10, constituted by a solenoid 140 and the lever 142 which are secured to a mounting plate 141. The lever 142 is pivotally mounted on a support shaft 144 and is at all times urged in the direction of the arrow k by an urging force of a torsion spring 143 wound around a lower portion of the lever 142. Furthermore, the lever 142 is regulated by a stopper (not shown) at the position shown by the solid lines of FIG. 10. The lever 142 is coupled with a plunger 140*a* of the solenoid 140. Upon energization of the solenoid 140, the plunger 140a is retracted and thus, the lever 142 is pivoted to the position shown by the one-dot chain lines of FIG. 10. A distal end of the lever 142 is disposed on rotational loci of the claw portions 129, 130 and 131 of the collar 123. As shown in FIG. 12, when the lever 142 is set at the position shown by the solid lines, the claw portions 129 and 131 are brought into contact with the lever 142. Meanwhile, when the lever 142 is set at the position shown by the one-dot chain lines, the claw portion 130 is brought into contact with the lever 142.

Here, the upper, intermediate and lower stages of the positions of the refeeding roller 38 is response to operations of the above described clutch means and the pivotal lever 145 are described sequentially.

Figure 11:
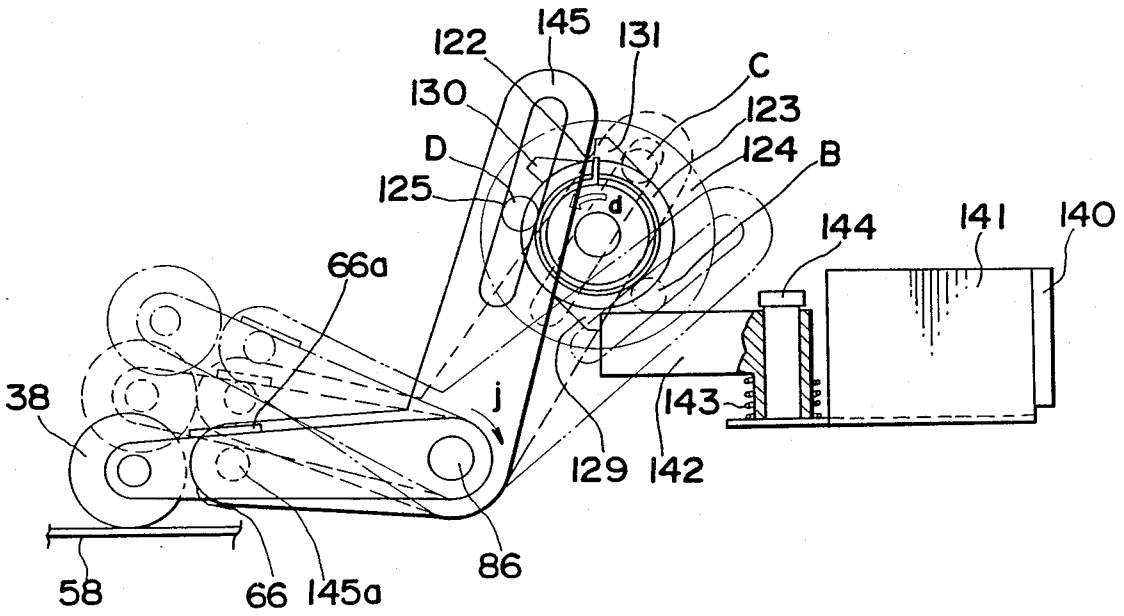
FIG. 11 is a view explanatory of operations of the pivotal mechanism of FIG. 10.

(1) Upper stage (One-dot chain lines in FIG. 11)

Figure 13:
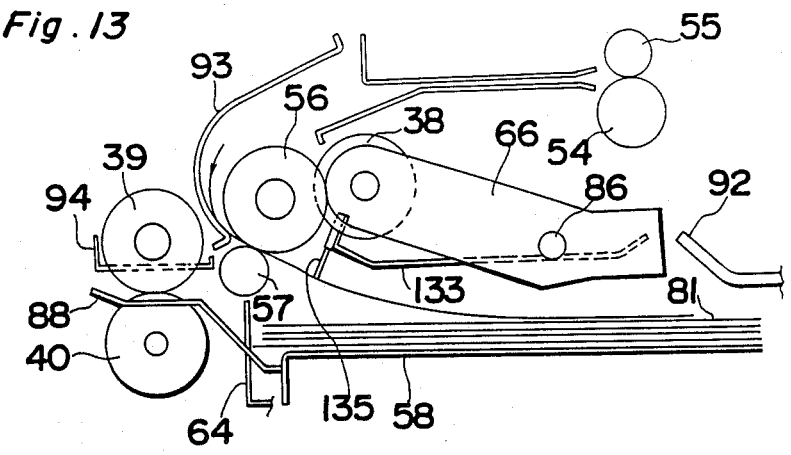
FIGS. 13, 14 and 15 are views explanatory of operations of the refeeding roller of FIG. 10.

When the refeeding roller 38 is positioned at the upper stage, the solenoid 140 is de-energized and thus, the claw portion 129 of the collar 123 is held in contact with the lever 142 in the direction of the arrow d. At this time, since the collar 123 is prevented from being rotated, rotation of the transport roller 54 is not transmitted to the clutch plate 124 even if the transport roller 54 is rotated in the direction of the arrow d. Thus, the pivotal lever 145 is held by the pin 125 at the position B shown by the two-dot chain lines in FIG. 11. Furthermore, the holder 66 is lifted by the shaft 145*a* of the pivotal lever 145 so as to be pivoted upwardly about the support shaft 86 such that the refeeding roller 38 is positioned at the upper stage shown by the one-dot chain lines in FIG. 11. When the copy paper sheets 81 are transported from the turnover block III onto the intermediate tray 58 at the time of duplex copying, the refeeding roller 38 is set at the upper stage as shown in FIG. 13.

(2) Intermediate stage (Dotted lines in FIG. 11)

Figure 14:
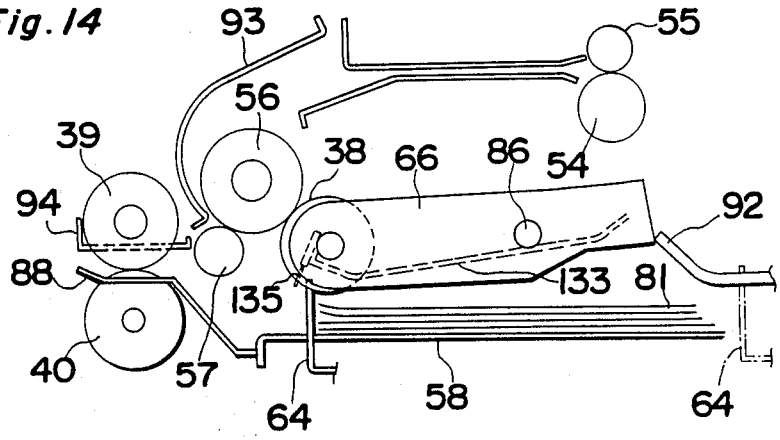

When the solenoid 140 is energized during rotation of the transport roller 54 in the direction of the arrow d, the claw portion 129 is brought out of contact with the lever 142. At this time, the kick spring 122 clamps the boss portions of the clutch plates 121 and 124, so that the clutch plate 124 and the collar 123 are rotated together in the direction of the arrow d. Accordingly, the claw portion 130 is brought into contact with the lever 142, so that the collar 123 is prevented from being rotated and the clutch plate 124 is also prevented from being rotated. Namely the collar 123 and the clutch plate 124 are rotated in the direction of the arrow d through an angle corresponding to a circumferential distance between the claws 129 and 130. Thus, the pivotal lever 145 is pivoted together with the pin 125 in the direction opposite to the arrow j so as to be held at the position C shown by the dotted lines in FIG. 11. Thus, the holder 66 is also pivoted downwardly in association with the shaft 145*a* and thus, the refeeding roller 38 is positioned at the intermediate stage shown by the dotted lines in FIG. 11. When the copy paper sheets 81 are transported from the transport rollers 50 and 52 onto the intermediate tray 58 at the time of composite copying, the refeeding roller 38 is set at the intermediate stage as shown in FIG. 14. Setting of the refeeding roller 38 and the holder 66 at the intermediate stage is aimed at preventing the copy paper sheets 81 by the refeeding roller 38 and the holder 66 from being ejected out of the intermediate tray 58 through upward curling of the leading edges of the copy paper sheets 81 when the copy paper sheets 81 aligned on the intermediate tray 58 are conveyed to the refeeding position.

(3) Lower stage (solid lines in FIG. 11)

Figure 15:
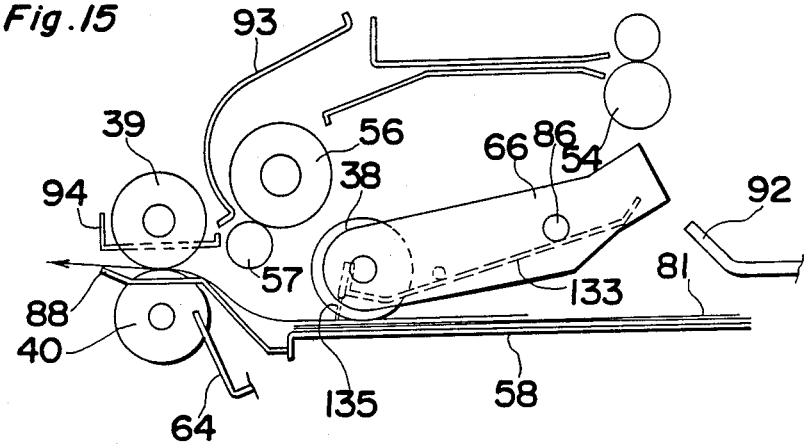

In the case where the solenoid 140 is de-energized when the refeeding roller 38 is positioned at the intermediate stage, the claw portion 130 is brought out of contact with the lever 142. At this time, the clutch plate 124 and the collar 123 are rotated together in the direction of the arrow d through a clamping force of the kick spring 122 until the claw portion 131 is brought into contact with the lever 142. Thus, the pivotal lever 145 is pivoted together with the pin 125 in the direction opposite to the arrow j so as to be held at the position D shown by the solid lines in FIG. 11. At this time, the shaft 145*a* of the pivotal lever 145 is disposed below a projecting piece 66*a* of the holder 66 and thus, the refeeding roller 38 is brought into pressing contact with the intermediate tray 58 by its own weight. Setting of the refeeding roller 38 at the lower stage is performed when the copy paper sheets 81 aligned on the intermediate tray 58 are refed. At this time, the refeeding roller 38 is brought into pressing contact, by its own weight, with the copy paper sheets 81 aligned on the intermediate tray 58 and refeed the copy paper sheets 81 one sheet by one sheet upon its rotation in the direction of the arrow j as shown in FIG. 15. Namely, a pressure required for refeeding the copy paper sheets 81 is obtained by the own weight of the refeeding roller 38. However, if necessary, it can also be so arranged that a spring or the like for urging the refeeding roller 38 downwardly is provided so as to impart to the refeeding roller 38 the pressure required for refeeding the copy paper sheets 81.

Here, alignment operations of the copy paper sheets 81 on the intermediate tray 58 are described with reference to FIGS. 16 to 27.

(1) Alignment at the time of duplex copying:

(a) Initially, the copy paper sheets 81 of size necessary for copying are selected, by using the operating panel (not shown), from the copy paper sheets 81 stored in the storage portions 42 and 43.

(b) The copying mode of the copying apparatus K is set to the duplex copying mode. Then, the changeover levers 41 and 59 (FIG. 1) are changed over to the positions shown by the solid lines in FIG. 1. The regulating plates 63, 64 and 65 are displaced by the stepping motors to the positions shown by the solid lines in FIGS. 16 to 18 so as to be placed in a waiting state. In this waiting state, an area enclosed by the regulating plates 62 to 65 is slightly larger than the size of the selected copy paper sheets 81. Namely, the front regulating plate 64 deviates slightly in the refeeding direction of the arrow g from a point of contact between the turnover transport rollers 56 and 57. This is aimed at preventing trailing edges of the copy paper sheets 81 transported onto the intermediate tray 58 by the turnover transport rollers 56 and 57 from riding over the front regulating plate 64 upon their release from the point of contact between the turnover transport rollers 56 and 57. In the waiting state, the rear regulating plate 65 is spaced a distance B from the front regulating plate 64. The distance B is so set as to be slightly larger than the size of the selected copy paper sheets 81. As shown in FIG. 16, the side regulating plate 63 is disposed slightly outwardly of a transport reference position X2 in the waiting state. The side regulating plate 63 is retracted from the transport reference position X2 in the waiting state because if the feed passage of the copy paper sheets 81 becomes longer, there is such a possiblity that an error in transport speed of the copy paper sheets 81 is produced in a widthwise direction of the copy paper sheets 81 due to variations of outside diameter or contact pressure of each transport roller in its axial direction, thereby resulting in oblique transport of the copy paper sheets 81. Meanwhile, the side regulating plate 62 is depressed in the direction of the arrow h by the coiled spring 69 upon de-energization of the solenoid 70 and thus, is pivoted to the position shown by the solid lines in FIG. 18 in the waiting state. On the other hand, the refeeding roller 38 is set at the upper stage shown in FIG. 13 so as to be retracted away from the intermediate tray 58 such that transport of the copy paper sheets 81 from the turnover transport rollers 56 and 57 onto the intermediate tray 58 is not prevented.

(c) Then, the number of copies to be taken is set. It is noted that the steps (a), (b) and (c) can be carried oout at random.

(d) A print switch is turned on.

Figure 23:
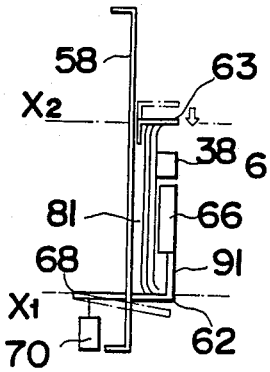
FIG. 23 is a side elevational view of FIG. 21.
Figure 21:
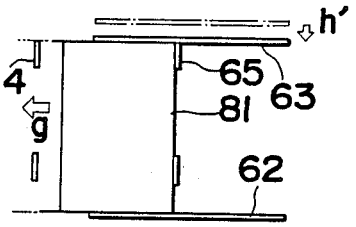
FIG. 21 is a top plan view of the alignment mechanism at the time of refeeding of copy paper sheets.
Figure 22:
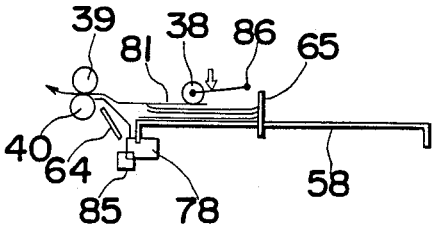
FIG. 22 is a front elevational view of FIG. 21.
Figure 24:
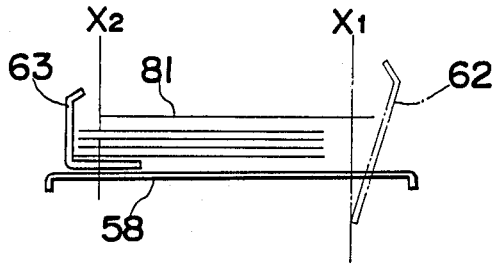
FIGS. 24 to 27 are views explanatory of alignment operations of the copy paper sheets in the copying apparatus of FIG. 1.
Figure 25:
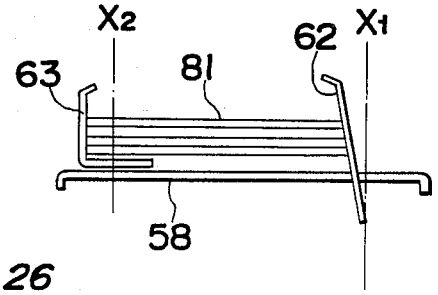
Figure 26:
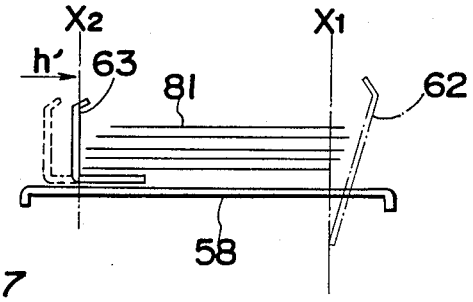
Figure 27:
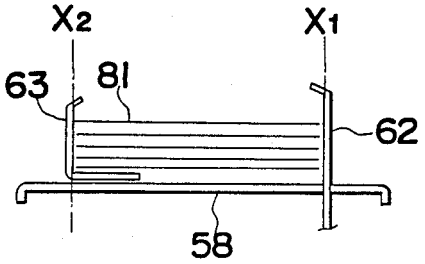

1. Each of the copy paper sheets fed from the storage portion 42 or 43 is subjected, on one face thereof, to copying in accordance with the above described copying steps and then, is transported in the direction of the arrow e of FIG. 17 by the transport block II. After a detection sensor 60 has been turned on, the copy paper sheets are turned over by the turnover transport rollers 56 and 57 so as to be conveyed onto the intermediate tray 58 such that the copied face of each of the copy paper sheets is directed upwardly.
2. In response to an ON signal of the detection sensor 60, the solenoid 70 is energized upon actuation of a delay timer immediately before the leading edge of each of the copy paper sheets reaches the intermediate tray 58. Meanwhile, the side regulating plate 62 is pivoted slightly outwardly in the direction of the arrow h' from the a transport reference position X1. The side regulating plate 62 is retracted slightly outwardly from the transport reference position X1 because oblique transport of the copy paper sheets may take place as described above.
3. When the trailing edge of each of the copy paper sheets 81 has been fully transported onto the intermediate tray 58, the solenoid 70 is de-energized and thus, the side regulating plate 62 is pivoted by the urging force of the coiled spring 69 (FIG. 5) to the position shown by the solid lines in FIGS. 16 and 18. At this time, the copy paper sheets 81 transported onto the intermediate tray 58 are preliminarily aligned with each other in contact with the side regulating plate 63.
4. The above describe steps 1 to 3 are repeated until the copy paper sheets 81 of the number of copies to be taken are transported onto the intermediate tray 58. Each time one of the copy paper sheets 81 is transported onto the intermediate tray 58, the side regulating plate 62 is pivoted such that the copy paper sheets 81 are aligned with each other by the other side regulating plate 63 as shown in FIGS. 24 and 25. This alignment is a preliminary operation for ensuring final alignment performed later.
5. When the copy paper sheets 81 of the number of copies to be taken have been transported onto the intermediate tray 58, the solenoid 70 is energized and thus, the side regulating plate 62 is pivoted outwardly to the position shown by the one-dot chain lines in FIGS. 16 and 18.
6. In this state, the copy paper sheets 81 deviate from the widthwise transport reference positions X1 and X2 and thus, the side regulating plate 63 is displaced to the transport reference position X2 as shown in FIG. 26. A travel speed of the side regulating plate 63 at this time is preferably set at about 30 mm/sec. or less.
7. At this time, several upper ones of the copy paper sheets 81 deviate in the direction of the arrow h' from the transport reference position X1 due to the inertia force as shown in FIG. 26. In order to align these copy paper sheets with the remaining copy paper sheets, energization and de-energization of the solenoid 70 are repeated several times so as to pivot the side regulating plate 62 several times such that the copy paper sheets 81 are completely aligned with each other. When this step 7 proceeds to the next step 8, the solenoid 70 is held in the energization state.
8. The solenoid 140 (FIG. 11) is energized twice so as to set the refeeding roller 38 at the lower stage such that the refeeding roller 38 is brought into pressing contact, by its own weight, with the copy paper sheets 81 as shown in FIGS. 15 and 22.
9. Subsequently, the solenoid 70 is de-energized. Thus, the side regulating plate 62 is pivoted inwardly by the urging force of the coiled spring 69 but is brought into contact with the stopper 91 (FIG. 10) formed on the holder 66. Hence, the side regulating plate 62 is set vertically at the transport reference position X1 as shown in FIGS. 23 and 27 such that the copy paper sheets 81 are prevented from being transported obliquely at the time of refeeding of the copy paper sheets 81.
10. At the same time, the slide member 73 is displaced to the position shown in FIG. 8, so that the front regulating plate 64 is pivoted about the support shaft 74 in the direction of the arrow i' so as to be retracted into the recesses 88*a* of the guide plate 88 such that refeeding of the copy paper sheets 81 is not prevented by the front regulating plate 64.
11. When the above described operations have been performed, a display indicating that display copying can be performed is made on the operating panel of the apparatus housing H. Meanwhile, the changeover 41 is changed over to the position shown by the one-dot chain lines in FIG. 1

(e) The print switch is turned on.

1. A main motor (not shown) is started so as to drive the transport rollers, etc. in the apparatus housing H.
2. A clutch (not shown) for the shaft 86 (FIG. 10) is actuated such that the refeeding roller 38 is driven for rotation thereof in the direction of the arrow j.
3. Since a coefficient of friction between the refeeding roller 38 and the copy paper sheets 81 is larger than that among the copy paper sheets 81, an uppermost one of the copy paper sheets 81 is refed and the refed copy paper sheets 81 are separated into a single sheet by the separating rollers 39 and 40.
4. Thereafter, the copy paper sheets 81 each having one copied face are transported to the timing rollers 13 by the transport rollers 32, 33 and 34. Then, the toner image is transferred onto the other face of each of the copy paper sheets 81. After the toner image on each of the copy paper sheets 81 has been fixed by the fixing device 9, the copy paper sheets 81 are guided to the discharge rollers 15 by the changeover lever 41 so as to be ejected onto the tray 36. Meanwhile, it can be also so arranged that the above described steps 1 to 4 are performed automatically upon completion of alignment of the copy paper sheets 81 without turning on the print switch.

(2) Alignment at the time of composite copying:

(a) The size of the copy paper sheets is selected in the same manner as the above described step (1)-(a).

(b) The copying mode is set to the composite copying mode. The changeover levers 41 and 59 are changed over to the positions shown by the solid lines in FIG. 1. The regulating plates 63 and 64 are displaced by the stepping motors to the positions shown by the solid lines in FIGS. 19 and 20 so as to be placed in the waiting state. In the waiting state, the rear regulating plate 65 deviates from the point of contact between the transport rollers 50 and 51 in the direction opposite to the refeeding direction of the arrow g. This is aimed at preventing the trailing edge of each of the copy paper sheets 81 transported onto the intermediate tray 58 from riding over the rear regulating plate 65 upon its release from the point of contact between the transport rollers 50 and 51. In the waiting state, the front regulating plate 64 is spaced the distance B from the rear regulating plate 65. The distance B is slightly larger than the size of the selected copy paper sheets. Meanwhile, the side regulating plate 62 is depressed in the direction of the arrow h by the coiled spring 69 upon de-energization of the solenoid 70 so as to be pivoted in the waiting state to the position shown by the solid lines in FIG. 18. On the other hand, the refeeding roller 38 is set at the intermediate stage shown in FIG. 14 so as to be disposed at a retracted position such that transport of the copy paper sheets 81 on the intermediate tray 58 to be described below is not prevented.

(c) Subsequently, the number of copies to be taken is set. In the same manner as the procedure (1), the above described steps (a), (b) and (c) can also be performed at random.

(d) The print switch is turned on.

1. The copy paper sheets each having one face subjected to a first copying operation are transported in the direction of the arrow f in FIG. 20 so as to turn on a detection sensor 61 and then, are transported onto the intermediate tray 58 such that the one copied face of each of the copy paper sheets is directed downwardly.
2. In response to an ON signal iof the detection sensor 61, the solenoid 70 is energized upon actuation of a delay timer immediately before the leading edge of each of the copy paper sheets 81 reaches the intermediate tray 58 and thus, the side regulating plate 62 is pivoted in the direction of the arrow h' slightly outwardly from the transport reference position X1.
3. When the trailing edge of each of the copy paper sheets 81 has been completely transported onto the intermediate tray 58, the solenoid 70 is de-energized and thus, the side regulating plate 62 is pivoted by the urging force of the coiled spring 69 (FIG. 5) to the position shown by the solid lines in FIG. 19. At this time, the copy paper sheets 81 transported onto the intermediate tray 58 are preliminarily aligned with each other in contact with the other side regulating plate 63.
4. Subsequently, the above described steps 1, 2 and 3 are repeated until the copy paper sheets 81 of the number of copies to be taken are transported onto the intermediate tray 58. Each time one of the copy paper sheets 81 is transported onto the intermediate tray 58, the side regulating plate 62 is pivoted such that the copy paper sheets 81 are preliminarily aligned with each other by the other regulating plate 63 as shown in FIGS. 24 and 25. This alignment is a preliminary operation for ensuring final alignment performed later.
5. When the copy paper sheets 81 of the number of copies to be taken have been transported onto the intermediate tray 58, the stepping motors are started so as to displace the regulating plates 64 and 65 to the refeeding position forwardly in the direction of the arrow g, with the regulating plates 64 and 65 being spaced the distance B. Thus, the copy paper sheets 81 are transported on the intermediate tray 58 to the refeeding position.
6. Then, the solenoid 70 is energized so as to outwardly pivot the regulating plate 62 to the position shown by the one-dot chain lines of FIG. 18.
7. In this state, since the copy paper sheets 81 deviate from the widthwise transport reference positions X1 and X2, the side regulating plate 62 is displaced to the transport reference position X2 a shown in FIG. 26. A travel speed of the side regulating plate 63 at this time is preferable set at about 30 mm/sec. or less.
8. At this time, several upper ones of the copy paper sheets 81 deviate in the direction of the arrow h' of FIG. 26 due to the inertia force as described earlier. In order to align these copy paper sheets with the remaining copy paper sheets, energization and de-energization of the solenoid 70 are repeated several times so as to pivot the side regulating plate 62 several times such that the copy paper sheets 81 are completely aligned with each other. When this step 8 proceeds to the next step 9, the solenoid 70 is held in the energization state.
9. The solenoid 140 (FIG. 10) is energized once so as to position the refeeding roller 38 at the lower stage such that the refeeding roller 38 is brought into pressing contact, by its own weight, with the copy paper sheets 81 as shown in FIGS. 15 and 22.
10. Then, the solenoid 70 is de-energized as in the above described step (1)-(d)-9. Thus, the side regulating plate 62 is brought into contact with the stopper 91 of the holder 66 so as to be vertically set at the transport reference position X1 as shown in FIGS. 23 and 27.
11. At the same time, the front regulating plate 64 is retracted into the recesses 88a of the guide plate 88 in the same manner as in the above described step (1)-(d)-10.
12. When the above described steps have been carried out, a display indicating that composite copying can be performed is made. Meanwhile, the changeover lever 41 is changed over to the position shown by the one-dot chain lines in FIG. 1.

(e) The print switch is turned on. The above described steps (1)-(e)-1, 2, 3 and 4 are carried out such that composite copying performed on the copied face of each of the copy paper sheets. Meanwhile, as described earlier, it can also so arranged that the steps (1)-(e)-1, 2, 3 and 4 are carried out automatically upon completion of alignment of the copy paper sheets without turning on the print switch. In the alignment method referred to above, the copy paper sheets are preliminarily aligned with each other at the position deviating in the widthwise direction from the transport reference positions X1 and X2 each time one of the copy paper sheets is transported onto the intermediate tray 58. Then, after the copy paper sheets 81 of the number of copies to be taken have been transported onto the intermediate tray 58, the copy paper sheets 81 are displaced to the transport reference positions X1 and X2 so as to be aligned with each other again. Accordingly, the copy paper sheets 81 can be aligned with each other positively and accurately and thus, improper refeeding of the copy paper sheets 81 can be eliminated. Meanwhile, if a friction member made of rubber, etc. is provided on a bottom portion of the side regulating plate 63, inaccurate positioning of the copy paper sheets 81 transported onto the intermediate tray 58 can be obviated, thereby resulting in more positive alignment of the copy paper sheets 81. Furthermore, although the front regulating plate 64 is pivoted so as to be retracted from the refeeding passage of the copy paper sheets 81 at the time of refeeding of the copy paper sheets 81, it can also be so arranged that the front regulating plate 64 acts as the guide plate 88 at the time of its retraction from the refeeding passage.

Then, a charge erasing mechanism of the copying apparatus K is described with reference to FIGS. 28 to 30. since the copy paper sheets 81 transported into the intermediate tray unit A are heated through electric discharge of the charge eraser 5*b* or at the time the toner image on each of the copy paper sheets 81 is fixed by the fixing device 9 prior to alignment of the copy paper sheets 81, a certain amount of water content of the copy paper sheets 81 is evaporated from the copy paper sheets 81 and thus, the copy paper sheets 81 are in a state susceptible to electrical charging. Especially, at the time of duplex copying, since a feed distance of the copy paper sheets 81 becomes longer due to passage of the copy paper sheets 81 through the transport block II, the copy paper sheets 81 are electrically charged as a matter of fact. The electrically charged copy paper sheets 81 apply an attractive force to each other, thus resulting in such inconveniences that a number of the copy paper sheets 81 are refed at a time and the copy paper sheets 81 are transported obliquely. Thus, the charge erasing mechanism for subjecting the copy paper sheets 81 to charge erasing is provided in the intermediate tray unit A. It is preferable that charge erasing of the copy paper sheets 81 is performed immediately before the copy paper sheets 81 are transported onto the intermediate tray 58. If charge erasing is performed prior to a point of time immediately before the copy paper sheets 81 are transported onto the intermediate tray 58, for example, when the copy paper sheets 81 are transported into the intermediate tray unit A, the copy paper sheets 81 are electrically charged when passing through the transport rollers 52, 53, 54, 55, etc. Furthermore, since the copy paper sheets 81 are electrically charged at the time of refeeding of the copy paper sheets 81 due to friction among the copy paper sheets 81 being refed, charge erasing of the copy paper sheets 81 is required to be performed also at the time of refeeding of the copy paper sheets 81.

More specifically, as shown in FIG. 10, a guide plate 133 having a charge erasing brush 135 provided at a distal end thereof is rotatably mounted on the support shaft 86 and is at all times urged upwardly by a torsion spring 134 wound around the support shaft 86. The guide plate 133 is positioned by a stopper 136 mounted on the frame 114 of the intermediate tray unit A. Meanwhile, a retainer member 132 is formed on the holder 66 so as to extend above the guide plate 133. In response to downward pivotal movement of the refeeding roller 38 and the holder 66, the guide plate 133 is depressed downwardly by the retainer member 132 so as to be pivoted downwardly about the support shaft 86.

Figure 28:
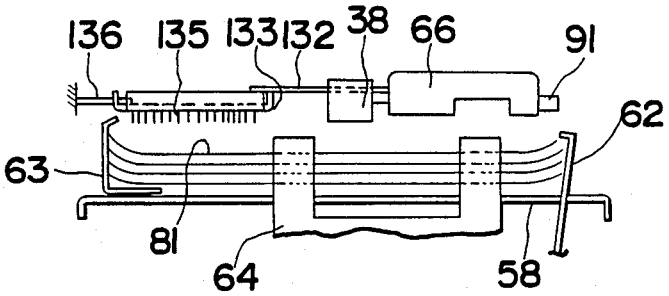
FIGS. 28 to 30 are views explanatory of operations of the refeeding roller and a charge erasing brush of the copying apparatus of FIG. 1.

FIG. 28 shows a state in which the refeeding roller 38 is set at the upper stage, namely a state in which the copy paper sheets 81 are transported onto the intermediate tray 58 at the time of duplex copying. At this time, the guide plate 133 is regulated in position by the stopper 136 so as to be set at upper stage in the same manner as the refeeding roller 38. Then, each of the copy paper sheets 81 is transported, in contact with the charge erasing brush 135, from the transport rollers 56 and 57 onto the intermediate tray 58 so as to be subjected to charge erasing as shown in FIG. 13.

Figure 29:
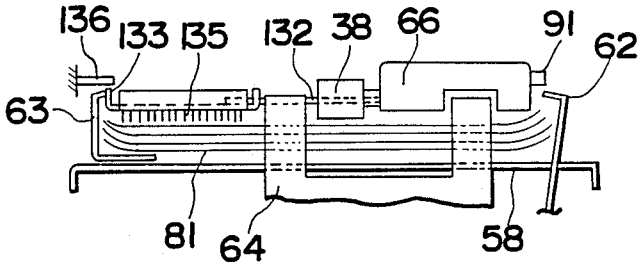

FIG. 29 shows a state in which the refeeding roller 38 is set at the intermediate stage, namely a state in which the copy paper sheets 81 are transported onto the intermediate tray 58 at the time of composite copying. At this time, the guide plate 133 is depressed by the retainer member 132 formed on the holder 66 so as to be set at the intermediate stage in the same manner as the refeeding roller 38 as shown in FIG. 14. At this time, the guide plate 133 functions as a guide of the copy paper sheets 81 in the same manner as the holder 66 and the refeeding roller 38 as will be described later.

Figure 30:
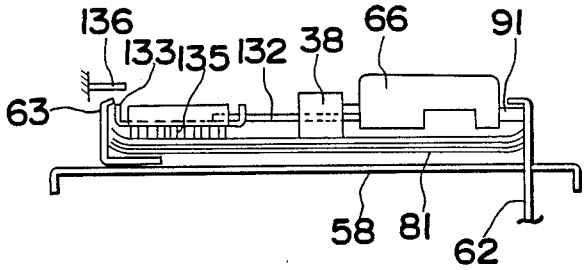

FIG. 30 shows a state in which the refeeding roller 38 is set at the lower stage, namely a state in which the copy paper sheets 81 are refed. At this time, the guide plate 133 is depressed by the retainer member 132 so as to be set at the lower stage in the same manner as the refeeding roller 38. Each of the copy paper sheets 81 is refed in contact with the charge erasing brush 135 so as to be subjected to charge erasing as shown in FIG. 15.

Figure 31:
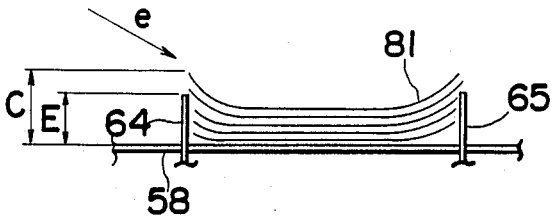
FIGS. 31 to 33 are front elevational views of a copy paper guide mechanism of the copying apparatus of FIG. 1.
Figure 32:
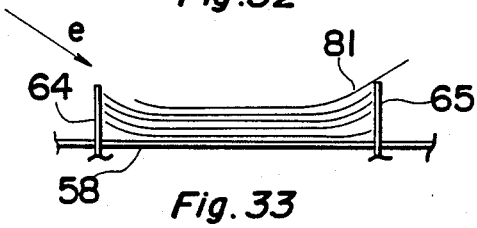
Figure 33:
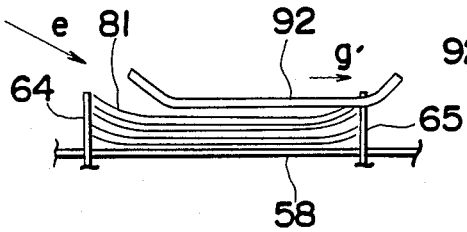
Figure 34:
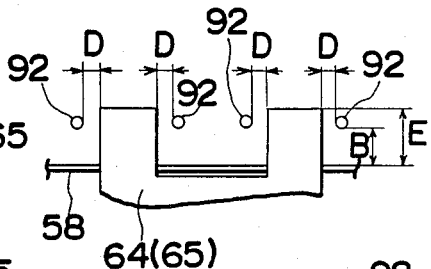
FIGS. 34 to 36 are side elevational views of the copy paper guide mechanism of FIGS. 31 to 33.
Figure 35:
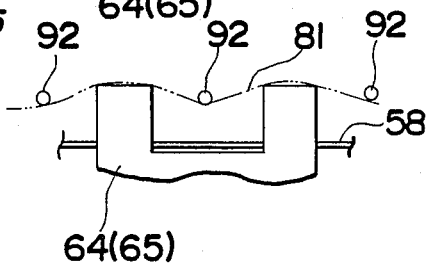

Then, a guide mechanism for guiding the copy paper sheets 81 is described with reference to FIGS. 31 to 36. After the toner image on each of the copy paper sheets 81 has been fixed by the fixd device 9, the copy paper sheets 81 may be readily curled by heat generated at the timer of fixing of the toner image on each of the copy paper sheets 81. In the case where a number of the upwardly curled copy paper sheets 81 are transported onto the intermediate tray 58, a height C of the copy paper sheets 81 stacked on the intermediate tray 58 becomes higher than a height E of the regulating plates 64 and 65 as shown in FIG. 31. If the next copy paper sheet 81 is further fed onto the intermediate tray 58 in this state, the copy paper sheet 81 will ride over the regulating plate 65 as shown in FIG. 32. Such an undesirable phenomenon can be eliminated by making the height of the regulating plate 65 larger. However, in this case, the intermediate tray unit A becomes larger in height unpreferably. Accordingly, in the copying apparatus K, guide members 92 are provided above the intermediate tray 58 so as to extend in the direction intersecting with the direction connecting the regulating plates 64 and 65 as shown in FIGS. 33 and 34. In this case, a height B of the guide members 92 is smaller than the height E of the regulating plates 64 and 65 and a distance D between the guide members 92 and the regulating plates 64 and 65 is set at a relatively small value. By this arrangement, it becomes possible to positively prevent the copy paper sheets 81 from riding over the regulating plates 64 and 65. The distance D is set at the small value because such a problem arises if the distance D is set at a large value that the copy paper sheet 81 is deformed as shown by the two-dot chain lines in FIG. 35 so as to ride over the regulating plates 64 and 65.

Meanwhile, FIG. 33 shows positions of the regulating plates 64 and 65 at the time of duplex copying. At the time of composite copying, the regulating plates 64 and 65 are displaced in the direction of the arrow g′ from the positions shown in FIG. 33, so that the regulating plate 64 intersects with the guide member 92 and thus, the leading edge of the copy paper sheet 81 transported onto the intermediate tray 58 is prevented from riding over the regulating plate 64.

On the other hand, in the case where the copy paper sheets 81 of a long dimension are transported onto the intermediate tray 58 at the time of composite copying as shown in FIG. 14, the front regulating plate 64 is disposed forwardly of the guide member 92 and thus, the leading edge of the upwardly curled copy paper sheet 91 cannot be guided by the guide member 92. Therefore, the refeeding roller 38, the holder 66 and the guide plate 133 are set at the intermediate stage so as to guide the leading edge of the copy paper sheet 81 as described above such that the leading edge of the copy paper sheet 81 is prevented from riding over the front regulating plate 64.

Meanwhile, if the guide member 92 is extended to the refeeding roller 38, it becomes unnecessary to provide a guide constituted by the holder 66, etc. However, if the guide member 92 is extended excessively in the refeeding direction of the copy paper sheet 81, such a disadvantage is incurred that the copy paper sheet 81 transported from the transport roller 56 and 57 at the time of duplex copying comes into contact with the guide member 92. The guide member 92 is mounted on the frames 106 and 107 of the transport block II and is lifted upwardly when the transport block II is pivoted upwardly. When the transport block II is pivoted upwardly, such a requirement should be satisfied that the guide member 92 does not interfere with the transport roller 54 provided on the frames 113 and 114 of the intermediate tray unit A. Hence, it is impossible to extend the guide member 92 in the refeeding direction of the arrow g from the position shown in FIG. 14.

Figure 36:
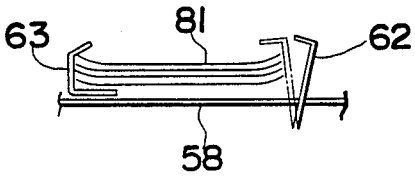

Furthermore, in order to deal with the copy paper sheet 81 curled in the direction perpendicular to the transport direction of the copy paper sheet 81, upper portions of the side regulating plates 62 and 63 are bent inwardly as shown in FIG. 36 such that the curled copy paper sheet 81 is prevented from riding over the side regulating plates 62 and 63.

Meanwhile, the guide plate 133 has a function of preventing opposite lengthwise side portions of the copy paper sheet 81 from deviating upwardly at the time of refeeding of the copy paper sheets 81. Namely, in this embodiment, since the refeeding roller 38 depresses the central portion of the copy paper sheet 81, the opposite lengthwise side portions of the copy paper sheet 81 curled in the widthwise direction deviate upwardly. If the copy paper sheet 81 is refed in this state, oblique transport or jamming of the copy paper sheet 81 takes place. In the copying apparatus K, in order to obviate such a problem, not only the refeeding roller 38 and the holder 66 but the guide plate 133 are disposed at the lower stage at the time of refeeding of the copy paper sheet 81 such that the holder 66 and the guide plate 133 guide the opposite lengthwise side portions of the copy paper sheet 81 from avove, respectively as shown in FIG. 30.

Figure 37:
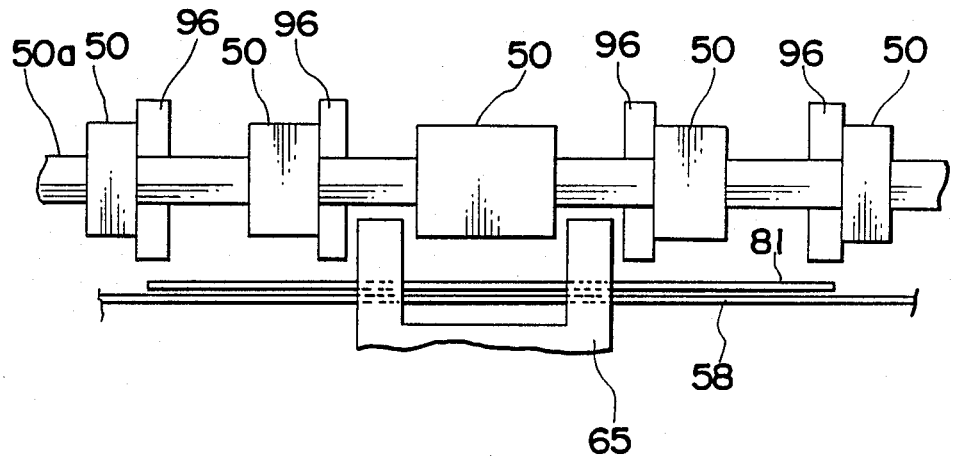
FIG. 37 is a side elevational view of a copy paper transport portion of the copying apparatus at the time of composite copying.
Figure 38:
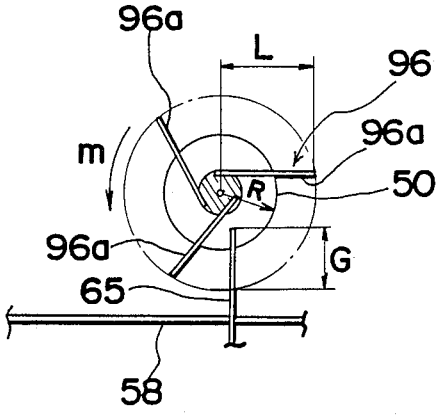
FIG. 38 is a sectional view of FIG. 37.
Figure 39:
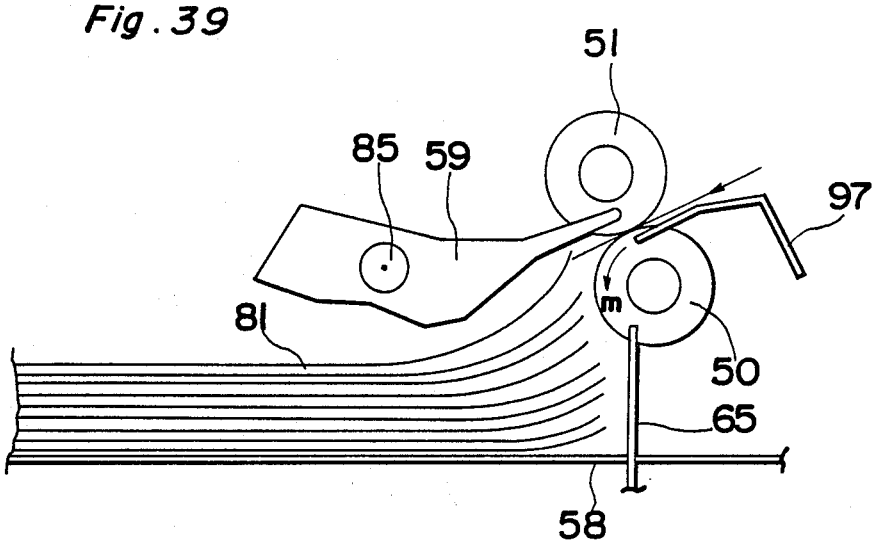
FIGS. 39 and 40 are views explanatory of operations of the copy paper transport portion of FIG. 37.
Figure 40:
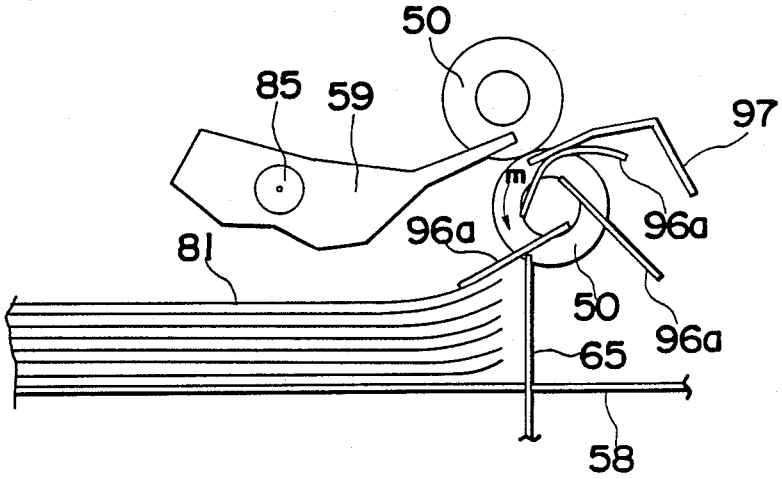

Furthermore, an auxiliary alignment mechanism for composite copying is described with reference to FIGS. 36 to 40. At the time of composite copying, the copy paper sheet 81 is guided by a guide plate 97 so as to be transported onto the intermediate tray 58 by the transport rollers 50 and 51 as shown in FIG. 39. If a number of the copy paper sheets 81 curled upwardly are transported onto the intermediate tray 58, the trailing edge of an upper one of the copy paper sheets 81 stacked on the intermediate tray 58 is raised above the point of contact between the transport rollers 50 and 51 and thus, jamming of the copy paper sheet 81 transported subsequently onto the intermediate tray 58 takes place. In this embodiment, in order to deal with this problem, the transport roller 60 is divided into a plurality of sections mounted on a support shaft 50*a* at a predetermined interval and a plurality of elastic blade members 96 each having a plurality of, for example three blades 96*a* are attached to arbitrary positions of the support shaft 50*a* as shown in FIG. 37. The elastic blade member 96 are disposed outwardly of the rear regulating plate 65 in the axial direction of the support shaft 50*a* so as to be brought into contact with the opposite lengthwise side portions of the copy paper sheet 81. The blades 96*a* of each of the elastic blade members 96 are disposed at an identical interval circumferentially and are inclined towards the rotational direction of the arrow m of the transport roller 50. As shown in FIG. 38, a length L of the blades 96*a* is larger than a radius R of the transport roller 50 such that the blades 96*a* overlap the rear regulating plate 65 through a distance G during rotation of the transport roller 50. Accordingly, the elastic blade members 96 are rotated together with the transport roller 56 in the direction of the arrow m and depress the upwardly deviating trailing edge of the curled copy paper sheet 81 so as to prevent jamming of the copy paper sheet 81.

Figure 9:
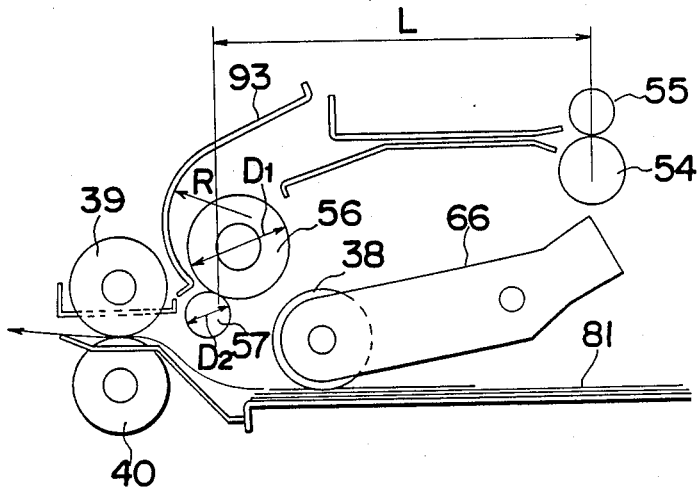
FIG. 9 is a view explanatory of relation between a refeeding portion and transport rollers of a turnover block employed in the copying apparatus of FIG. 1.

Then, relation between the turnover transport rollers 56 and 57 and the turnover guide plate 93 is described with reference to FIG. 9. At the time of duplex copying, the turnover transport rollers 56 and 57 and the turnover guide plate 93 for turning over the copy paper sheet 81 immediately before transport of the copy paper sheet 81 onto the intermediate tray 58 are required to turn over a hard copy paper sheet such as a board or a soft copy paper sheet such as a thin paper or curled copy paper sheet positively. The present inventors conducted experiments by setting a diameter D1 of the turnover transport roller 56, a diameter D2 of the turnover transport roller 57, a radius R of the turnover guide plate 93 and a distance L between the point of contact between the transport rollers 54 and 55 and that between the turnover transport rollers 56 and 57 to various values. As a result of the experiments, the present inventors have found the following points (a) to (d).

(a) In order to turn over a hard copy paper sheet, the diameters D1 and D2 and the radius R should be made large when thet distance L is small.

(b) when the distance L is small, the transport rollers provided before the transport rollers 54 and 55 should be increased in number, thereby resulting in rise of production cost of the copying apparatus. Therefore, from the standpoint of the production cost of the copying apparatus, it is preferable that the distance L is made longer. The distance L is required to be at least as large as a length of a copy paper sheet of a minimum size.

(c) In order to turn over the copy paper sheet, the radius R and the diameter D1 are desirably made larger. However, if the radius R and the diameter D1 are made exceedingly large, the intermediate tray unit A is made large in size.

(d) In the intermediate tray unit A in which the copy paper sheet is turned over immediately before being transported onto the intermediate tray 58, the turnover transport rollers 56 and 57 are necessarily provided between the refeeding roller 38 and the separating rollers 39 and 40. Furthermore, the turnover tranport rollers 56 and 57 are required to be so provided as not to interfere with the copy paper sheet at the time of refeeding of the copy paper sheet and as to make the intermediate tray unit A compact in size. To this end, it is preferable that diameters D1 and D2, especially the diameter D2 of the lower turnover transport roller 57 should be made as small as possible.

In order to effect smooth turnover of the copy paper sheet and make the intermediate tray unit A compact in size in view of the above described points (a) to (d), the following conditions (1) and (2) should be preferably satisfied.

$$D2 \leqq D1 \quad (1)$$

$$(D\tfrac{1}{2}) \leqq R \quad (2)$$

The above described conditions (1) and (2) are satisfied in this embodiment.

Meanwhile, the copying apparatus of the present invention is not restricted to the above described embodiment and can be modified variously in the scope of the present invention. Especially, the copying apparatus can also be so arranged to effect only either one of duplex copying and composite copying. In this case, the refeeding roller 38 is merely required to be displaced to tow stages, i.e. the lower stage at the time of refeeding of the copy paper sheets and the upper stage for upwardly retracting the refeeding roller 38.

As is clear from the foregoing description, in accordance with the present invention, transport speed of the copy paper sheets can be reduced through efficient utilization of space in the copying apparatus and jamming of the copy paper sheets can be dealt with easily by drawing the intermediate tray unit outwardly even if jamming of the copy paper sheets takes place at the turnover portion.

Furthermore, in the copying apparatus of the present invention, the guide member 92 for guiding the upper face of each copy paper sheet is provided in the direction intersecting with the front regulating plate 64 and the rear regulating plate 65. Accordingly, even if a number of the copy paper sheets curled upwardly are stacked on the intermediate tray 58, the copy sheets are depressed by the guide member 92 so as to be aligned with each other positively. Thus, in accordance with the present invention, the front regulating plate 64 and the rear regulating plate 65 are not required to be made so large in height and thus, the intermediate tray portion can be made compact in size, thereby making the copying apparatus compact in size.

Moreover, in the coping apparatus of the present invention, the diameter D2 of the lower turnover transport roller 57 is made smaller than the diameter D1 of the upper turnover transport roller 56 and the the radius R of the turnover guide plate 93 is made larger than the radius ($D\frac{1}{2}$) of the upper turnover transport roller 56. Therefore, in accordance with the present invention, the copy paper turnover portion and the refeeding roller portion can be made compact in size and it becomes possible to turn over the copy paper sheets positively regardless of thickness of the copy paper sheets.

In addition, in the copying apparatus of the present invention, when the refeeding roller 38 is disposed at the refeeding position, the guide plate 133 is also displaced synchronously with the refeeding roller 38 so as to depress from above the copy paper sheet being refed. Accordingly, in accordance with the present invention, even if the copy paper sheet is curled upwardly in the widthwise direction, the copy paper sheet can be guided on the intermediate tray 58 positively, thus obviating such improper refeeding of the copy paper sheet as oblique transport of the copy paper sheet.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A copying apparatus capable of effecting duplex copying and composite copying and comprising:

means for housing said apparatus;

a unitary intermediate tray means for storing a plurality of copy paper sheets transported thereto and refeeding plurality of copy paper sheets transported thereto and refeeding the stored copy paper sheets therefrom, one sheet at a time, with the copy paper sheets each having one copied face;

said intermediate tray means comprising a storage portion for storing and stacking thereon the copy paper sheets transported sequentially thereto, a first transport portion, a second transport portion and a paper feeding means for feeding, one sheet at a time, the copy paper sheets stored in sheet storage portion;

said first transport portion being pivotally provided at least partially so as to be pivoted relative to said storage portion and transporting the copy paper sheets to said storage portion through turnover of the copy paper sheets at the time of duplex copying such that each of the copy paper sheets on said storage portion has the one copied face directed upwardly;

said second transport portion transporting the copy paper sheets to said storage portion at the time of composite copying such that each of the copy paper sheets on said storage portion has the one copied face directed downwardly; and a mounting means for detachably mounting said intermediate tray means to be drawn out of said means for housing said copying apparatus in a direction perpendicular to a transport direction of the copy paper sheets.

2. A copying apparatus as claimed in claim 1, wherein said intermediate tray means further comprises:

a pair of platelike alignment members for positioning a leading edge and a trailing edge of each of the copy paper sheets transported to said storage portion, said alignment members extending in the direction perpendicular to the transport direction of the copy paper sheets; and a guide member for guiding the copy paper sheets, which intersects with said alignment members so as to extend in parallel with the transport direction of the copy paper sheets and is disposed lower in height than said alignment members.

3. A copying apparatus as claimed in claim 1, wherein said paper feeding means is pivotally provided so as to be pivoted to a first position for depressing an uppermost one of the copy paper sheets stored in said storage portion and a second position for allowing the copy paper sheets to be transported to said storage portion by said first transport portion, with the second position being higher than the first position.

4. A copying apparatus as claimed in claim 3, wherein said intermediate tray means further comprises a guide means, said guide means being disposed adjacent to said paper feeding means in a widthwise direction of the copy paper sheets stored in said storage portion and being pivotally provided so as to be pivoted synchronously with pivotal movement of said paper feeding means.

5. A copying apparatus as claimed in claim 1, wherein said first transport portion comprises:

upper and a lower turnover transport rollers which are provided forwardly and upwardly of said paper feeding means and have a first and a second diameter, respectively such that the second diameter of the lower turnover transport roller is smaller than the first diameter of the upper turnover transport roller; and a turnover guide plate for guiding, through turnover of the copy paper sheets, the copy paper sheets to said upper and lower turnover transport roller, said guide plate extending up to a nip portion of said upper and lower turnover transport rollers and has a radius larger than a half of the first diameter of said upper turnover transport roller.

6. A copying apparatus comprising:

means for housing said apparatus;

a unitary intermediate tray means for storing a plurality of copy paper sheets transported sequentially thereto and refeeding the stored copy paper sheets therefrom one sheet at a time, with the copy paper sheets each having one copied face;

said intermediate tray means comprising a storage protion for storing and stacking thereon the copy paper sheets transported thereto, a transport portion and a paper feeding means for feeding, one sheet at a time, the copy paper sheets stored in said storage portion;

said transport portion being pivoting provided at least partially so as to be pivoted relative to said storage portion and transporting the copy paper sheets to said storage portion through turnover of the copy paper sheets such that each of the copy paper sheets on said storage portion has the one copied face directed upwardly;

a mounting means for detachably mounting said intermediate tray means to be drawn out of said means for housing said copying apparatus in a direction perpendicular to a transport direction of the copy paper sheets;

a lock means for locking said intermediate tray means to said housing means when said intermediate tray means has been mounted on said housing means by said mounting means; and a lock release means for releasing, through operation thereof from outside of said housing means, locking action of said lock means, said lock release means being provided in said intermediate tray means.

7. A copying apparatus capable of effecting duplex copying and composite copying and comprising:

means for housing said apparatus;

a unitary intermediate tray means for storing a plurality of copy paper sheets transported thereto and refeeding the stored copy paper sheets therefrom, one sheet at a time, with the copy paper sheets each having one copied face;

said intermediate tray means comprising a storage portion for storing and stacking thereon the copy paper sheets transported sequentially thereto, a first transport portion, a second transport portion and a paper feeding means for feeding, one sheet at a time, the copy paper sheets stored in said storage portion;

said first transport portion being so provided at least partially as to be released upwardly away from said storage portion and transporting the copy paper sheets to said storage portion through turnover of the copy paper sheets at the time of duplex copying such that each of the copy paper sheets on said storage portion has the one copied face directed upwardly;

said second transport portion transporting the copy paper sheets to said storage portion at the time of composite copying such that each of the copy paper sheets on said storage portion has the one copied face directed downwardly;

a mounting means for detachably mounting said intermediate tray means to be drawn out of said means for housing said copying apparatus in a direction perpendicular to a transport direction of the copy paper sheets;

a lock means for not only locking said intermediate tray means to said housing means but also locking said first transport portion to said intermediate tray means when said intermediate tray means has been mounted on said housing means by said mounting means; and a lock release means for releasing, through operation thereof from outside of said housing means, locking action of said lock means, said lock release means being provided in said intermediate tray means.

8. A duplex copying apparatus comprising:

means for housing said apparatus;

a unitary intermediate tray means for storing a plurality of copy paper sheets transported thereto and refeeding the stored copy paper sheets thereform, one sheet at a time, with the copy paper sheets each having one copied face;

said intermediate tray means comprising a storage portion for storing and stacking thereon the copy paper sheets transported sequentially thereto, a transport portion and a paper feeding means for feeding, one sheet at a time, the copy paper sheets stored in said storage portion;

said transport portion being so provided at least partially as to be released upwardly away from said storage portion and transporting the copy paper sheets through turnover of the copy paper sheets such that each of the copy paper sheets has the one copied face directed upwardly;

a mounting means for detachably mounting said intermediate tray means to be drawn out of said means for housing said copying apparatus in a direction perpendicular to a transport direction of the copy paper sheets;

a lock means for not only locking said intermediate tray means to said housing means but also locking said transport portion to said intermediate tray means when said intermediate tray means has been mounted on said housing means by said mounting means; and a lock release means for releasing, through operation thereof from outside of said apparatus housing, locking action of said lock means, said lock release means being provided in said intermediate tray means.

* * * * *